US006459862B1

(12) United States Patent
Sakemi et al.

(10) Patent No.: US 6,459,862 B1
(45) Date of Patent: Oct. 1, 2002

(54) DEVELOPING APPARATUS

(75) Inventors: Yuji Sakemi, Numazu; Shigeo Kimura, Mishima; Fumitake Hirobe, Odawara, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/688,110

(22) Filed: Oct. 16, 2000

(30) Foreign Application Priority Data

Oct. 18, 1999 (JP) ..... 11-295675
Oct. 28, 1999 (JP) ..... 11-307588
Jan. 13, 2000 (JP) ..... 2000-004965

(51) Int. Cl.[7] ..... G03G 15/00; G03G 15/08
(52) U.S. Cl. ..... 399/55; 399/270; 399/285
(58) Field of Search ..... 399/53, 55, 43, 399/270, 285

(56) References Cited

U.S. PATENT DOCUMENTS 4,777,107 A 10/1988 Kurematsu et al. ..... 430/122
5,659,840 A * 8/1997 Miyamoto et al. ..... 399/55
5,669,050 A 9/1997 Sakemi et al. ..... 399/270
5,752,140 A 5/1998 Danzuka et al. ..... 399/270
5,860,040 A * 1/1999 Shimizu et al. ..... 399/55
5,937,228 A * 8/1999 Shoji et al. ..... 399/55
5,999,777 A 12/1999 Masuda et al. ..... 399/222
6,052,544 A * 4/2000 Shimizu et al. ..... 399/55
6,128,449 A * 10/2000 Zenba et al. ..... 399/55 X
6,163,663 A * 12/2000 Shinohara et al. ..... 399/55

FOREIGN PATENT DOCUMENTS

JP 06-274025 * 9/1994
JP 09-311539 * 12/1997
JP 11-119521 * 4/1999

* cited by examiner

*Primary Examiner*—Sophia S. Chen
(74) *Attorney, Agent, or Firm*—Fitzpatrick, Cella, Harper & Scinto

(57) ABSTRACT

A developing apparatus has a developer carrying body provided to face an image bearing body. The developer carrying body carries and conveys a developer having toner and carrier to a developing region. A bias applying device applies a developing bias to the developer carrying body, wherein the bias applying device applies to the developer carrying body the developing bias having periodically a voltage portion having alternately a first voltage to generate an electric field to direct toner from the developer carrying body to the image bearing body and a second voltage to generate an electric field to direct the toner from the image bearing body to the developer carrying body and a pause portion to pause applying the alternate voltage, wherein T1 and T2 have a relationship of T1>T2, where T1 is as an applying time period of the first voltage and T2 is an applying time period of the second voltage.

12 Claims, 27 Drawing Sheets

DEVELOPING APPARATUS

BACKGROUND OF THE INVENTION

1. Field of the Invention

The present invention relates to a developing apparatus used for image forming apparatus of an electrophotographic or electrostatic recording type such as photocopier and a printer.

2. Related Background Art

In an image forming apparatus of electrophotographic or electrostatic recording type, developing is generally realized by causing an image bearing body bearing an electrostatic latent image to correspond to a developing sleeve (a developer carrying body) carrying developer of a developing device, and in order to generate a developing electric field between an image bearing body and a developing sleeve, a developing bias is applied to the developing sleeve.

As this developing bias, as shown in FIG. 15, the one in which an AC component is superimposed on a DC component has been used, and rectangular waves of the AC component shown in FIG. 15 with a frequency of about 2 kHz (½ cycle=250 $\mu$s) and a peak-to-peak voltage (Vpp) of about 2 kV are conventionally used to obtain a good developed image.

However, a developing bias as shown in FIG. 15 has disadvantages that a highlighted portion of an image "suffers from coarse image" and that a sufficient image density cannot be obtained in case of a smaller particle size of toner of developer.

To remedy these disadvantages, as shown in FIG. 16, it has been proposed by the present applicant that a developing bias having an AC component intermittently superimposed on a DC component is used. However, this developing bias suffers from problems as follows.

A developing bias (to be referred to as blank pulse bias or BP bias herein) as shown in FIG. 16 presents developing performance better than a developing bias (to be referred to as a rectangular bias herein) as shown in FIG. 15, but as a condition to prevent a coarse image in a highlighted portion, it is essential that a frequency of a pulse portion is raised to not less than 4 kHz (½ cycle=125 seconds). In addition, as a condition to increase image density, it is necessary that Vpp of a pulse portion is not less than 2 kV as in a conventional rectangular wave.

In case of Vpp of a pulse portion exceeding 2 kV with a frequency not less than 4 kHz, when a conductive foreign material contaminates a developing section, problems occur that an abnormal discharge takes place in that portion, ring-form spots are formed on an image, and image quality is seriously deteriorated.

Accordingly, in the case where a BP bias is used, Vpp is required to be controlled to be lower than in case of a conventional rectangular bias.

SUMMARY OF THE INVENTION

It is an object of the present invention to provide a developing apparatus that can perform sufficient development with a Vpp lower than a conventional rectangular bias.

It is another object of the present invention to provide a developing apparatus that performs good development with an appropriate developing bias, prevents a coarse image in a highlighted section, makes a sufficient image density available, and never suffers from image defects due to an abnormal discharge.

It is still another object of the present invention is to provide a developing apparatus comprising:

a developer carrying body provided to face an image bearing body, wherein the developer carrying body carries and conveys a developer having toner and carrier to a developing region; and bias applying means for applying a developing bias to the developer carrying body, wherein the bias applying means applies to the developer carrying body the developing bias having periodically an alternate voltage portion having alternately a first voltage to generate an electric field to direct toner from the developer carrying body to the image bearing body and a second voltage to generate an electric field to direct the toner from the image bearing body to the developer carrying body and a pause portion to pause applying the alternate voltage, wherein T1 and T2 have a relationship of T1>T2, where T1 is an applying time period of the first voltage and T2 is an applying time period of the second voltage.

It is yet another object of the present invention is to provide a developing apparatus comprising:

a developer carrying body provided to face an image bearing body, wherein the developer carrying body carries and conveys a developer having toner and carrier to a developing region;

bias applying means for applying a developing bias to the developer carrying body, wherein the bias applying means applies to the developer carrying body the developing bias having periodically an alternate voltage portion having alternately a first voltage to form an electric field to direct toner from the developer carrying body to the image bearing body and a second voltage to form an electric field to direct the toner from the image bearing body to the developer carrying body and a pause portion to pause applying the alternate voltage, wherein a potential difference Vg between an effective center voltage of the developing bias voltage and the first voltage is larger than a potential difference Vb between an effective center voltage of the developing bias voltage and the second voltage.

Objects of the present invention other than those described above as well as characteristics of the present invention will become more apparent by reading the following detailed description with reference to attached drawings.

DESCRIPTION OF THE PREFERRED EMBODIMENTS

Now, embodiments according to the present invention will be described in detail with reference to drawings.

Embodiment 1

Figure 1:
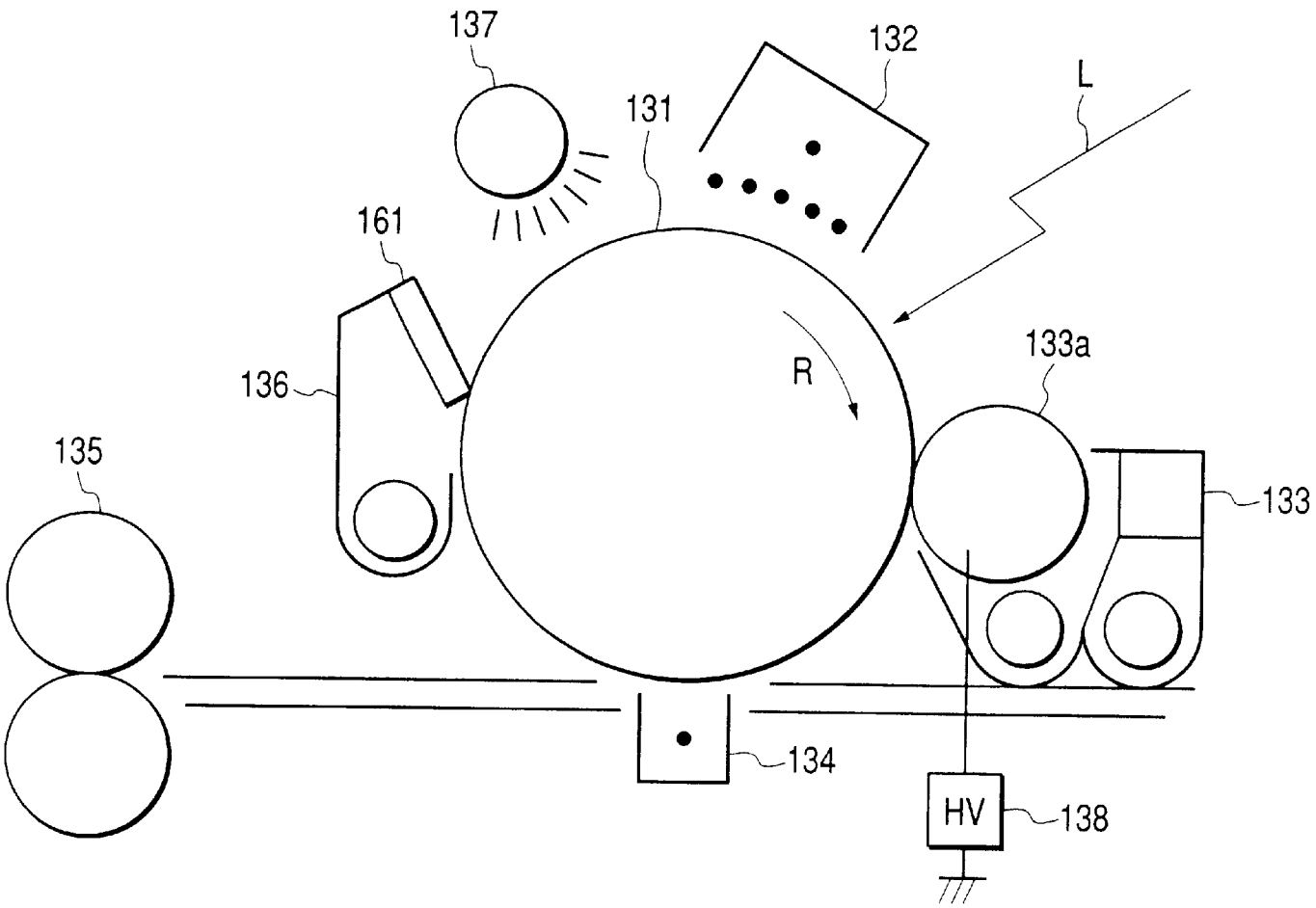
FIG. 1 is a schematic block diagram showing an embodiment of an image forming apparatus of the present invention.

FIG. 1 is a schematic block diagram showing an embodiment of an image forming apparatus of the present invention.

In FIG. 1, a photosensitive drum 131 as an electrostatic latent image bearing body rotates in a direction shown by an arrow R in the drawing, and its surface is charged evenly with a primary charger 132. Thereafter, the photosensitive drum 131 is imagewise exposed to a laser beam L and an electrostatic latent image is formed on the surface. The electrostatic latent image is developed under application of a developing bias by a developing apparatus 133 with a two-component developer consisting of toner and carriers and visualized as a toner image. In this embodiment, the toner is charged in negative polarity. The obtained toner image is transferred by a transfer charger (charging device) 134 onto a sheet conveyed by a not shown sheet conveyer, thereafter is fixed by a fixer (fixing device) 135, to be outputted as an image.

In the transferring step, toner not transferred remaining on the photosensitive drum 131 is cleaned by a cleaning apparatus 136 having a cleaning blade 161 pressed onto the photosensitive drum 131. Thereafter, the photosensitive drum 131 is uncharged by a preexposing apparatus 137 to be used to form an image again.

Figure 2:
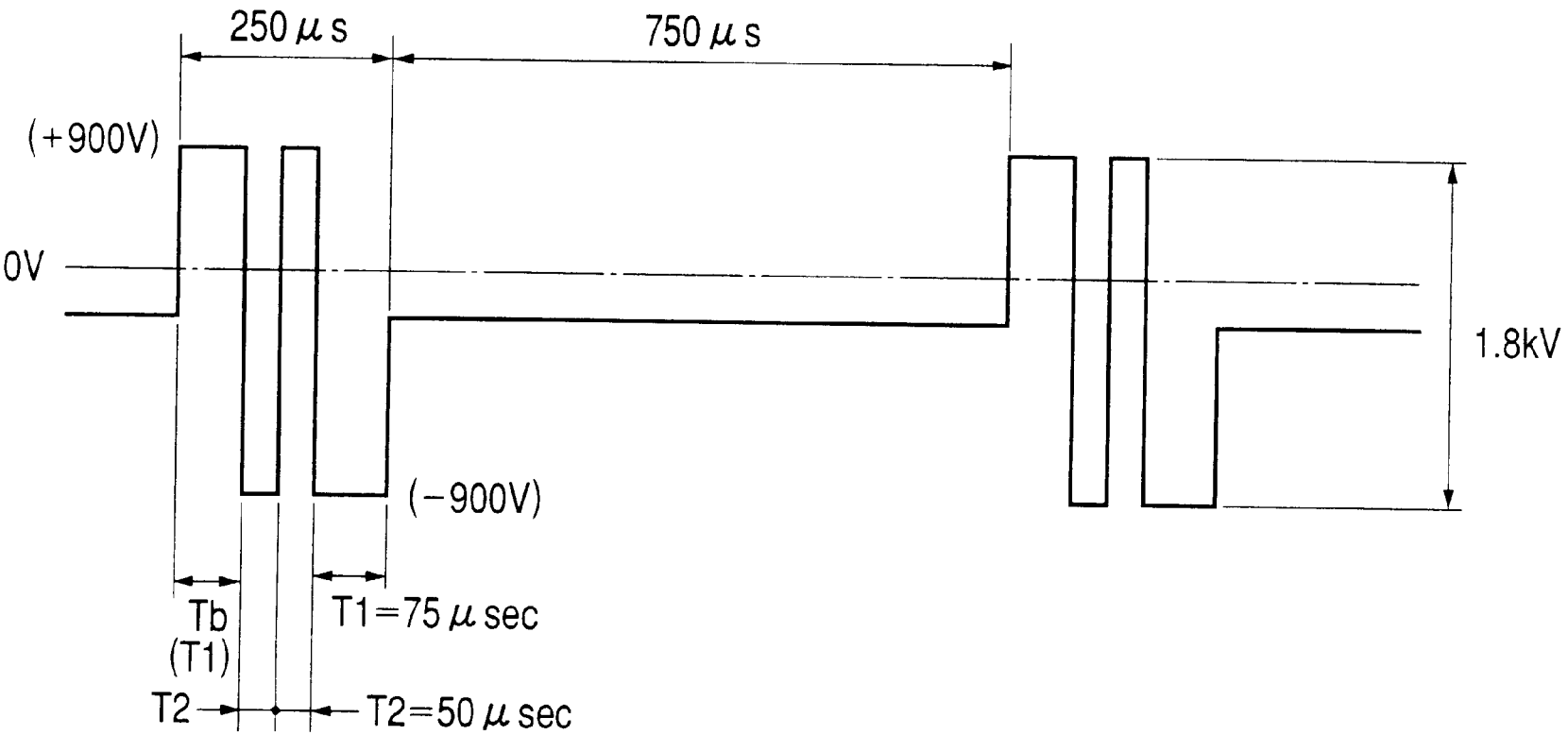
FIG. 2 is a waveform graph showing a BP bias used in the embodiment in FIG. 1.

The present invention is characterized in that a BP bias is devised so that the BP bias is applied to a developing sleeve (a developer carrying body) 133*a* of a developing device 133 from a developing power supply 138 being bias applying means as a developing bias at the time of development. A developing bias used in this embodiment is shown in FIG. 2. This developing bias voltage is a BP bias (a blank pulse bias) periodically having a pause portion (a blank portion) and an oscillating portion (an alternate voltage portion), and the oscillating portion is formed with four pulses. In FIG. 2 where Tb is the maximum application time period of a voltage in such a direction that the toner is brought back to the developing sleeve will fulfill $Tb \geqq T1$.

Immediately after the pause portion, this oscillating portion applies a voltage of +900 V in relation to the potential of the pause portion for a time period of Tb=T1 as an electric field to bring the toner back to the developing sleeve of the developer 133, thereafter applies a voltage of −900 V for a time period of T2, then applies a voltage of +900 V for a time period of T2, finally applies a voltage of −900 V in relation to the potential of the pause portion for a time period of T1 as an electric field in such a direction to cause the toner to fly to the photosensitive drum 131, and thereafter will enter a pause portion.

In this embodiment, the time period in the pause portion is 6×(T1+T2) hours. A waveform is selected to satisfy the relation of T1=1.5×T2. Since a cycle of T1+T2 is selected to be 8 kHz, in this embodiment, the time period for the oscillating portion is 250 μs (micro seconds), the time period for the pause portion is 750 μs, T1=75 μs, T2=50 μs, and the bias becomes a BP bias with a cycle of 1000 μs for the oscillating portion and the pause portion together and with a frequency of 1 kHz.

Figure 3:
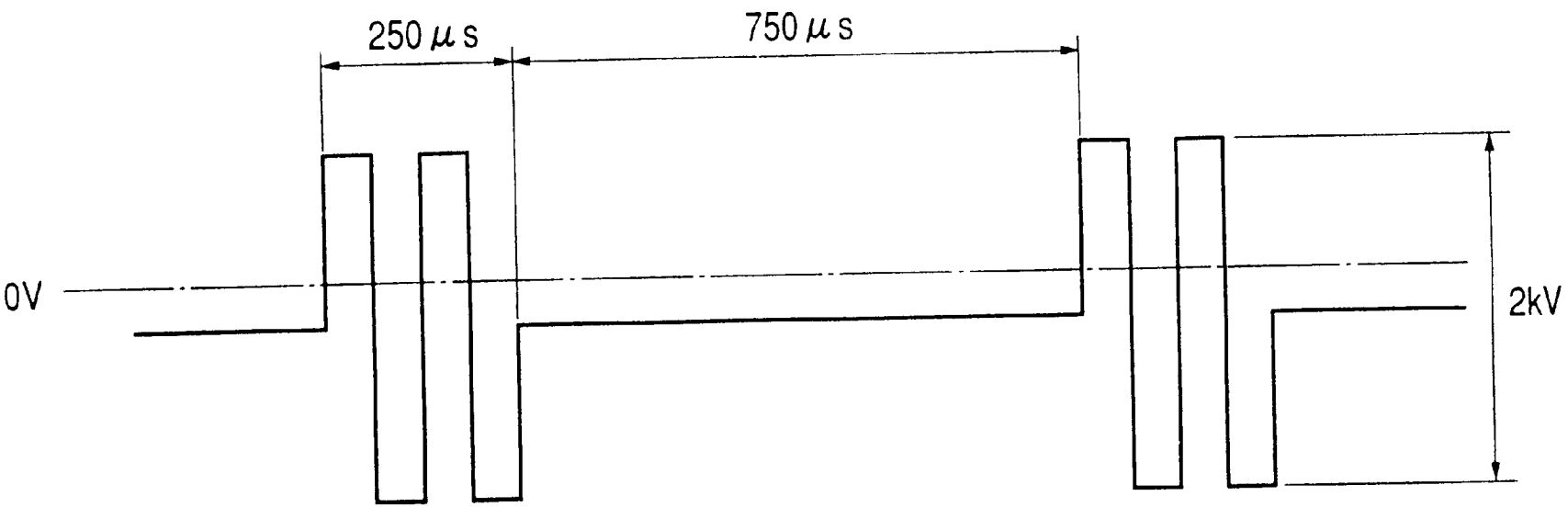
FIG. 3 PRIOR ART
FIG. 3 is a waveform graph showing a conventional BP bias.
Figure 4:
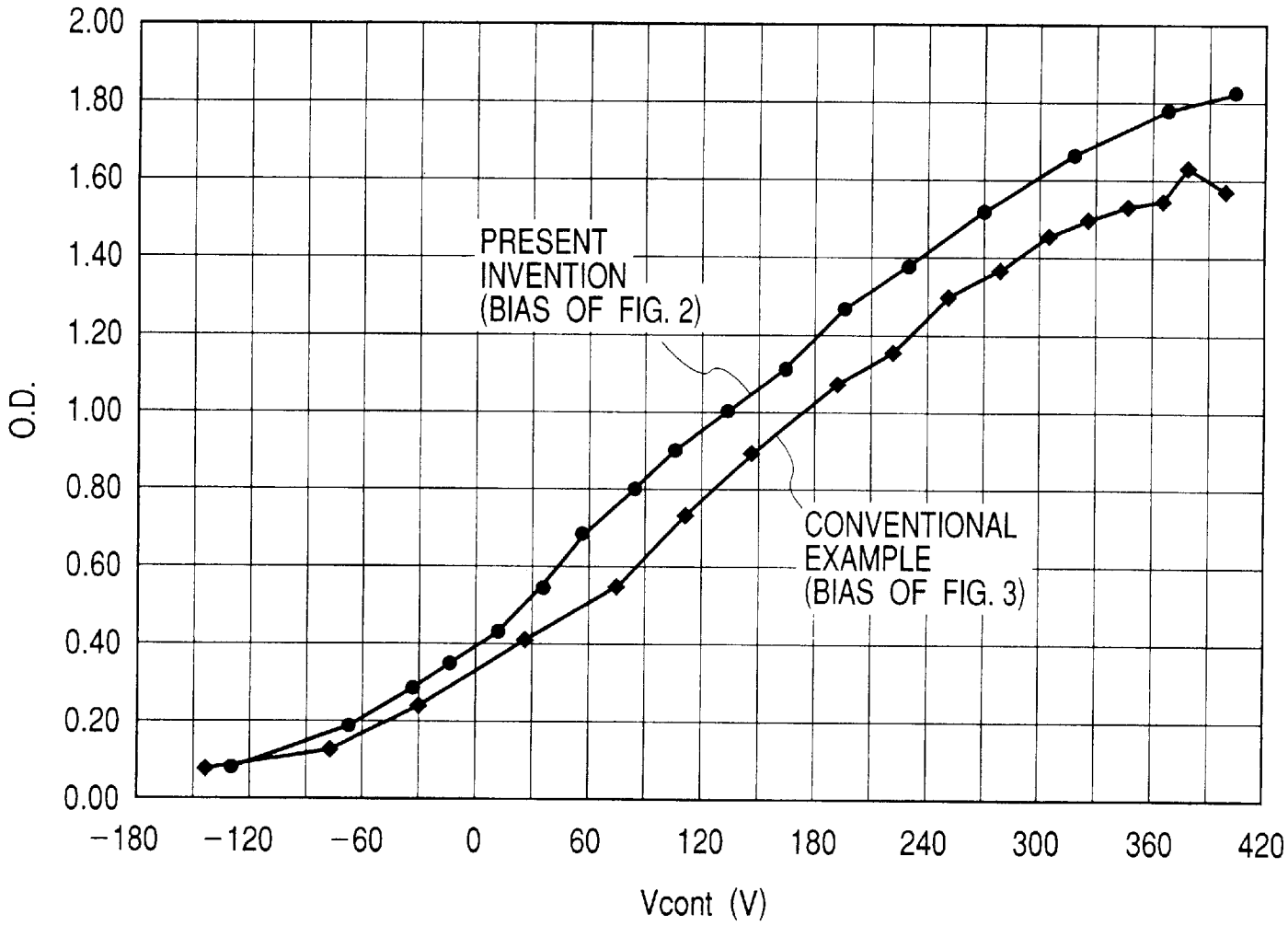
FIG. 4 is a graph showing V-D curves in the case where the biases of FIG. 2 and FIG. 3 are used to output images under the same conditions.

A waveform of a BP bias that has been proposed before is shown in FIG. 3. In FIG. 3, the bias has a peak-to-peak voltage Vpp set to 2 kV (while in FIG. 2, the bias has Vpp set to less than 2 kV, particularly to 1.8 kV). In FIG. 4, V-D (developing contrast vs. image density) curves are shown in the case where images are outputted with biases of FIG. 2 and FIG. 3 under the same conditions.

As shown in FIG. 4, using the BP bias of FIG. 2 as a developing bias in the present invention, a density that has obtained only if the Vpp of the BP bias is raised to 2 kV can be completely obtained even if the Vpp drops to less than 2 kV, particularly to 1.8 kV.

In this embodiment, the Vpp of the BP bias can be controlled to stay at 1.8 kV, and consequently, an electrically conductive foreign material eventually contaminating a developing section does not give rise to any poor image due to an abnormal discharge that used to be a problem so that images with a high density are constantly available.

Figure 5:
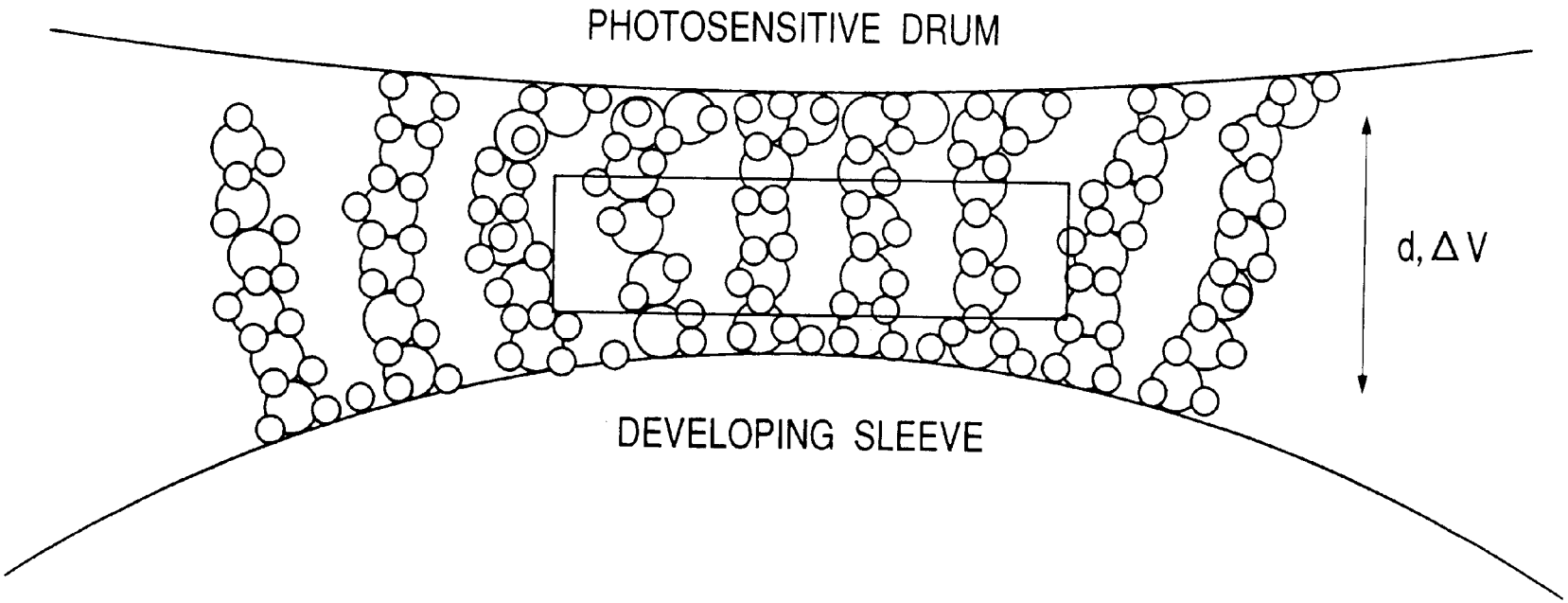
FIG. 5 is a view showing the force applied to a toner particle on a developing sleeve.
Figure 6:
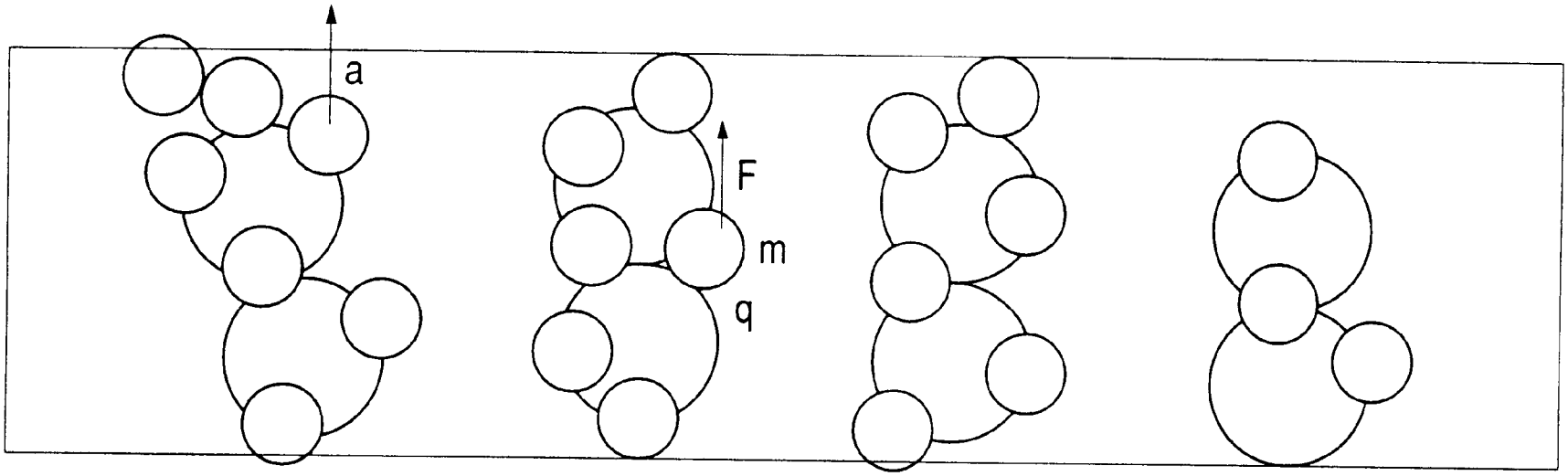
FIG. 6 is an enlarged view of FIG. 5.

The reasons why sufficient density becomes available may be considered to be as follows. FIG. 5 is a view showing the force applied to a toner particle on a developing sleeve, and FIG. 6 is an enlarged view thereof. In the figures, reference character q denotes a quantity of electric charge of toner, reference character m denotes mass, reference character a denotes acceleration, reference character ΔV denotes a potential difference between the photosensitive drum and the developing sleeve, and reference character d denotes a gap between the photosensitive drum and the developing sleeve.

Now, a force that the toner receives during developing will be examined. A force in a direction of the toner flying from the developing sleeve to the photosensitive drum becomes maximum when an electric field is formed in a direction of the toner flying to the photosensitive drum under the bias of the oscillating portion applied. In addition, a quantity of the toner adheres to an image section is considered to depend on the velocity of a toner accelerated by an electric field when a shift occurs from the oscillating portion to the blank portion (pause portion). A velocity with which the toner resting on the developing sleeve is accelerated will be compared for the present invention and for a conventional case when a voltage of the oscillating portion is applied, and such a voltage that makes the toner fly from the developing sleeve toward the photosensitive drum is applied immediately before shifting to a pause portion.

The accelerated velocity of the toner can be expressed by:

$$V=|q|/m\times\Delta V/d\times TL.$$

Supposing that contrast necessary for developing is 350 V, ΔV for a conventional bias will be 1350 V. On the other hand, for a bias of the present invention, ΔV will be 1250 V. The other values will be same for the bias of the conventional bias and for the bias of the present invention. Thus letting V2 to be the velocity of the toner at the moment of the conventional bias application entering a blank portion, and V1 to be the velocity of the toner for bias application of the present invention, the following relation is satisfied:

$$V1=1.23\times V2,$$

and even if Vpp is low, the flying velocity of the toner will be high, and consequently, a sufficient image density would be obtained even with low Vpp.

Embodiment 2

In the Embodiment 1, the BP bias shown in FIG. 2 is used, but a bias effective for the present invention will not be limited to the bias of FIG. 2.

Figure 7:
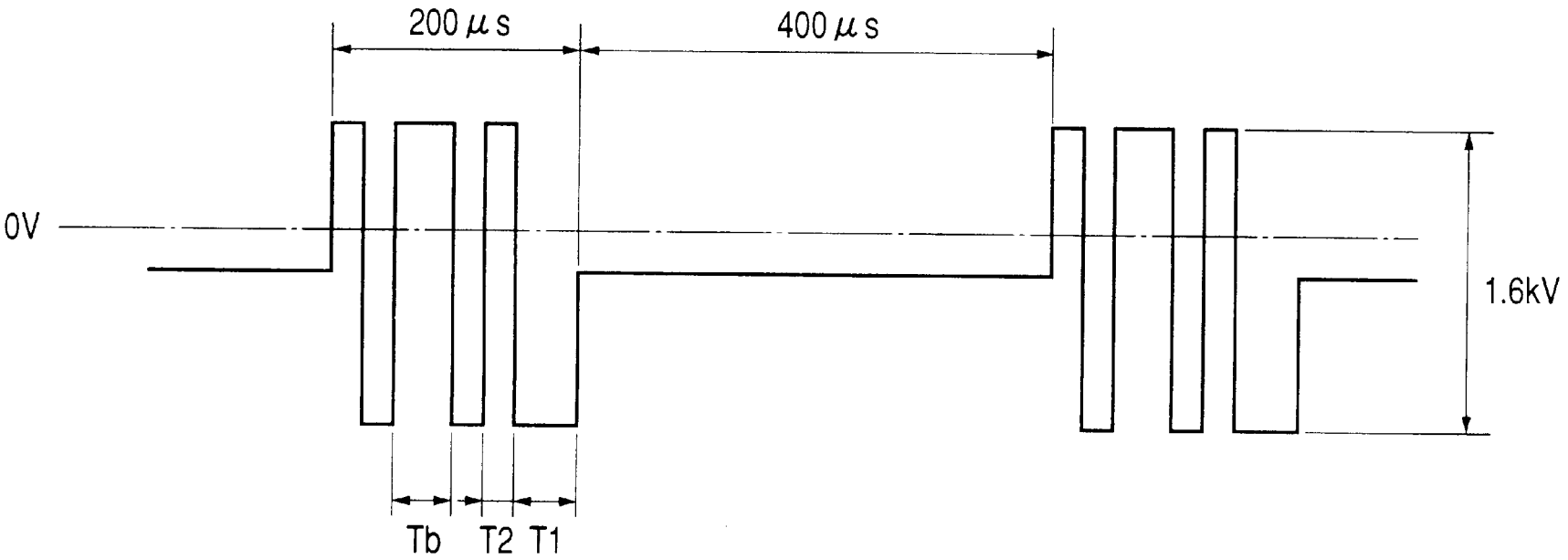
FIG. 7 is a waveform graph showing a BP bias used in another embodiment of the present invention.

A BP bias used as a developing bias in this embodiment is shown in FIG. 7. The BP bias of this embodiment has an oscillating portion having a plurality of oscillations. In the figure, a waveform is selected to satisfy the relation of T1=2×T2 with T1=50 μs and T2=25 μs. This BP bias has the same effect as in Embodiment 1 by setting an integrated value to zero as in the BP bias of FIG. 2 when a plurality of oscillations are implemented.

According to the BP bias of FIG. 7, a sufficient density is obtained, and no poor images due to an abnormal discharge occurs when Vpp is set to 1.6 kV. In addition, with such a BP bias, images with little coarseness and little unevenness are also obtained as in the Embodiment 1.

Embodiment 3

Another embodiment of image forming apparatus of the present invention will be described with reference to FIG. 8.

The image forming apparatus of this embodiment is a color photocopier having a digital color image reader section in the upper part and a digital color image printer section in the lower part.

In the reader section, an original 30 is placed upon a glass stand 31 for an original, and a reflected light image from the original 30 obtained by exposing and scanning with an exposure lamp 32 is focused onto a full color sensor 34 with a lens 33 to obtain color-separated color image signals. These color-separated color image signals are amplified with a not shown amplifying circuit, then subjected to processing with a not shown video processing unit, and are sent out to the printer section.

In the printer section, a photosensitive drum 1 as an image bearing body is a photosensitive body having a surface protecting layer and is installed rotatably in the direction of an arrow in the figure. In the circumference of this photosensitive drum 1 are disposed a preexposing lamp 11 to initialize a surface of the photosensitive drum 1, a charger 2 to uniformly charge the surface of the photosensitive drum 1 (a corona charging device in this example), a laser exposing optics system to form an electrostatic latent image based on the image information on the surface of the photosensitive drum 1, a developing apparatus fixedly disposed comprised of four developing devices 4 (4Y, 4C, 4M, and 4K), containing developer (toner) of different colors to develop the electrostatic latent image formed on the photosensitive drum 1, light detecting means 13 to detect a quantity of toner on the photosensitive drum 1, and a cleaner 6 to remove residual developer remaining on the photosensitive drum 1, etc.

The laser exposing optics system, in this example, comprises a polygon mirror 3*a*, a lens 3*b*, and a mirror 3*c* and the like, in which laser beam is modulated with color-separated image signals from the above described reader section, and converted into light signals of image scan exposing at a laser output section, the converted laser beam E is reflected with the polygon mirror 3*a*, and projected through the lens 3*b* and the mirror 3*c* onto the surface of the photosensitive drum 1, to form electrostatic latent images corresponding to color image signals of respective colors.

At the time when an image is formed in the printer section, the photosensitive drum 1 is rotated in the direction of an arrow in the figure, and at first, a surface of the photosensitive drum 1 is discharged and initialized with the preexposing lamp 11, and subsequently the surface of the photosensitive drum 1 is negatively charged uniformly with a charger 2, and the surface of the photosensitive drum 1 is sequentially exposed to the laser beams E respectively corresponding to image signals of respective colors color-separated with the exposing optics 3 so that an electrostatic latent image is formed in a predetermined color sequence.

Next the predetermined developing devices are operated in the order of cyan (C), magenta (M), yellow (Y), and black (K) in a predetermined developing order so that a latent image upon the photosensitive drum 1 undergoes developing, and a toner image with resin-based negative toner is sequentially formed on the photosensitive drum 1. Here, the developing devices 4C, 4M, 4Y, and 4K of the developing apparatus are configured so that operation of eccentric cams 24C, 24M, 24Y, and 24K results in a developing operation in which respective developing devices approach alternatively to the photosensitive drum 1 based on a color in the formed latent image.

On the other hand, recording material such as a transferring sheet fed by a conveying system comprising a pickup roller, a sheet feeding guide, and a sheet feeding roller, etc. from a cassette for recording material 7*a*, 7*b*, or 7*c* (or occasionally by hand) is wound around a transferring apparatus 5 in synchronization with predetermined timing.

This transferring apparatus 5 has, in this example, a transferring drum 5*a* with a diameter of 180 mm as a recording material carrier, a transferring corona charging device 5*b* to transfer toner images on a photosensitive drum 1 onto a recording material, an adsorption charger 5*c* as adsorption charging means to adsorb the recording material onto the transferring drum 5*a*, an adsorption roller 5*g* as an opposite electrode, and an interior corona charging device 5*d* as well as an exterior corona charging device 5*e*, and in the peripheral opening region of the transferring drum 5*a* rotatably supported so as to be rotationally drived, a recording material bearing sheet 5*f* comprising dielectric as recording material carrying means is integrally spread to form a cylinder. As the recording material bearing sheet 5*f*, a dielectric sheet such as polycarbonate film, etc. is used.

Figure 8:
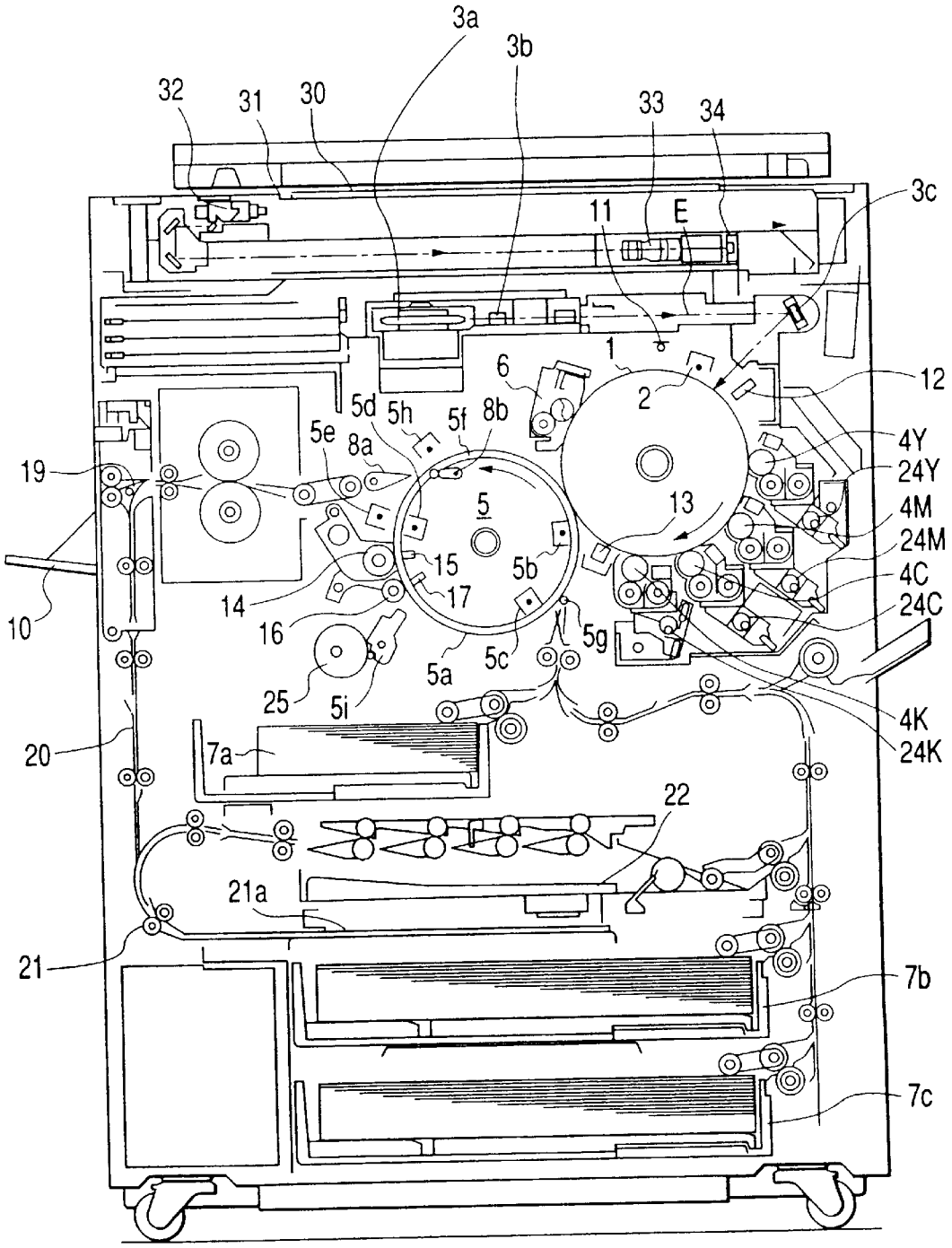
FIG. 8 is a schematic block diagram showing a still another embodiment of an image forming apparatus of the present invention.

The transferring drum 5*a* is rotationally driven in synchronization with the photosensitive drum 1 in the direction of an arrow shown in FIG. 8, and a cyan toner image obtained by development with the cyan toner image obtained by development with the cyan developing device 4C is transferred in the transferring section with the transferring charging device 5*b* onto the recording material carried on the recording material bearing sheet. The transferring drum 5*a* continues to rotate in preparation for transfer of an image in a next color (for example, magenta).

In addition, the photosensitive drum 1 onto which a toner image is transferred is cleaned with a cleaner 6 of an adhesive substance such as residual toner, etc., and again uniformly charged with the charger 2, and undergoes image-exposing as described above with a laser beam modulated by image signals of magenta of the next color. This latent image is developed with a magenta developing device, and visualized as a magenta toner image, and this magenta toner image is transferred by the transferring corona charging device 5*b* in the transferring section onto a recording material on a recording material bearing sheet 5*f* overlapped over a cyan toner image. The transferring drum 5*a* continues to rotate in preparation for transfer of an image in a next color (for example, yellow).

Subsequently, such image forming and transferring processes as described so far is performed for yellow and black, and when overlapping transfer of toner images of four colors onto a recording material is over, the recording material is discharged with a charger for separation 5*h*, is subsequently removed from the transferring drum 5*a* by the action of a pushup roller 8*b* and separating claw 8*a*, is conveyed to a fixing device 9 (in this example, a hot roller fixing device) with a conveying means to fix a toner image, and is discharged onto an exterior tray 10. Thus, a sequence of full color printing yields a desired full color print image.

In the case where an image is formed on both surfaces of the recording material, the recording material exits the fixing device 9, and immediately thereafter a carrying path switching guide 19 is operated to tentatively direct the recording material to a reverse path 21*a* via a vertical carrying path 20. Thereafter, reverse rotation of the reverse rollers 21 makes the recording material go along conveyance path 21*a* in a direction opposite to the direction in which it was fed with the rear end at the time when it was fed in ahead to be contained in an intermediate tray 22. Thereafter, the recording material is conveyed again from the intermediate tray 22 to the transferring apparatus 5, and an image is formed on another surface of the recording material by the above described image forming step.

The transferring drum 5*a* after removing the recording material is cleaned with a fur brush 14 and a backup brush 15 as well as an oil removing roller 16 and a backup brush 17 facing each other via the recording material bearing sheet 5*f* in order to prevent powder from scattering and adhering onto the recording material bearing sheet 5*f*, and oil from adhering onto the recording material and the like. Such cleaning is performed before the image forming or after the image forming, and is performed any time when a jam (blocking up with paper) takes place.

In addition, this example is configured so that by operating the eccentric cam 25 is operated at desired timing and operating cam follower 5*i* integrated with the transferring drum 5*a*, the gap between the recording material bearing sheet 5*f* and the photosensitive drum 1 can be arbitrarily set. For example, in standby time or power down time, a distance between the transferring drum 5*a* and the photosensitive drum 1 is increased.

Next, a process of an image processing section will be described with reference to a block diagram shown in FIG. 9.

Figure 9:
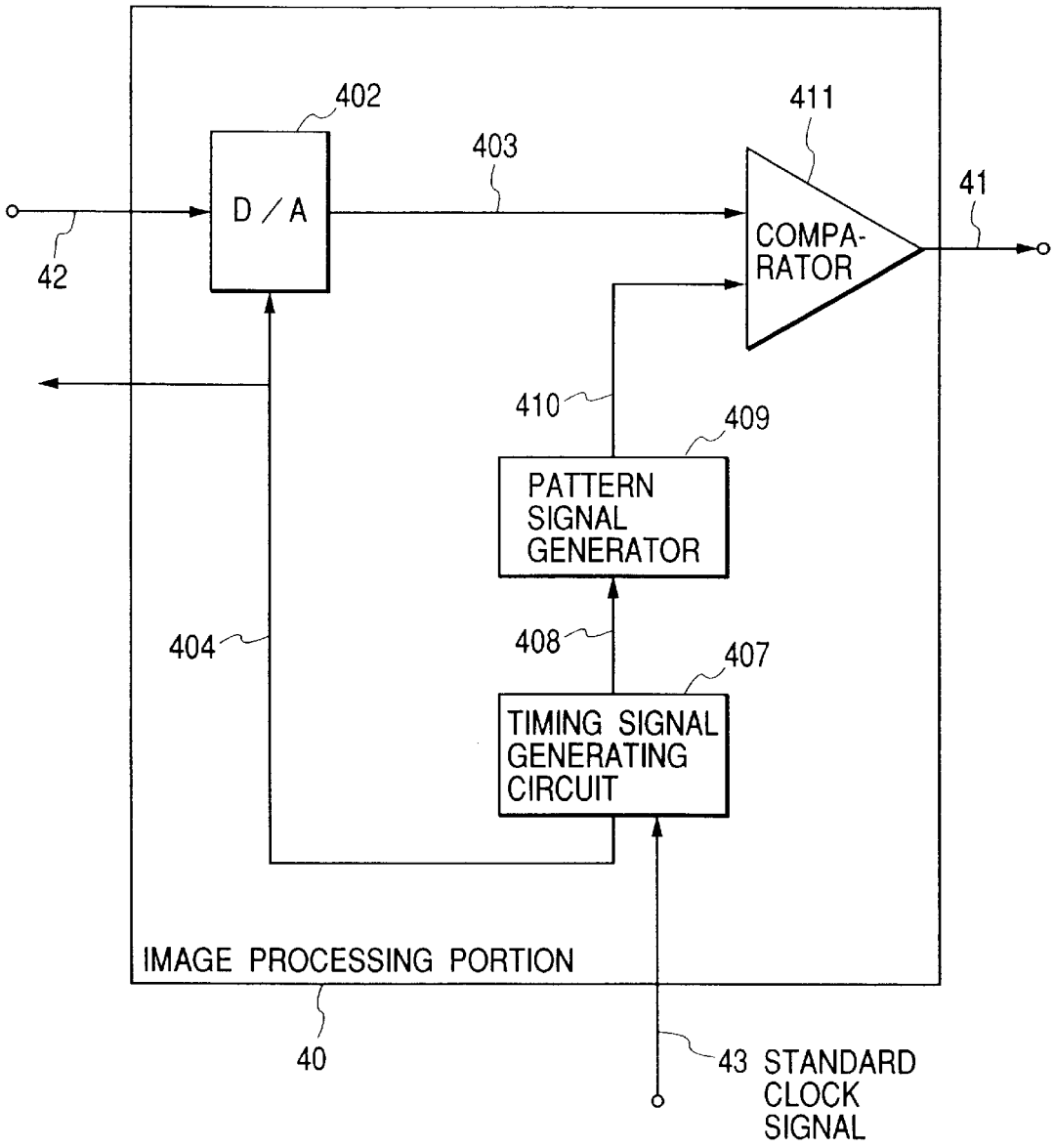
FIG. 9 is a block diagram showing an image processing section of the image forming apparatus in FIG. 8.

In the image processing section 40 of FIG. 9, digital image data 42 are converted into analog image signals 403 with a D/A converter 402 and are inputted to one terminal of a comparator 411. A timing signal generating circuit 407 generates and outputs a pixel clock 404 and a screen clock 408 into a pattern signal generator 409 in response to inputted standard clock signals 43. The pattern signal generator 409 outputs pattern signals 410 based on the screen clock 408 which are inputted into another terminal of the comparator 411.

The digital pixel signals 42 are inputted in synchronization to the pixel clock 404, and the D/A converter 402 outputs the analog image signals 403 in synchronization with the pixel clock 404. The screen clock 408 is a clock signal generated by multiplication of the pixel clock 404 by an integer, and defines a period of the pattern signal 410 which is for example a triangular wave.

The analog image signals 403 and the pattern signals 410 are compared by the comparator 411, and binarized image data 41 are generated and outputted which are pulse width modulated to 0 when the analog image signal 403 is bigger and 1 when smaller.

Figure 10:
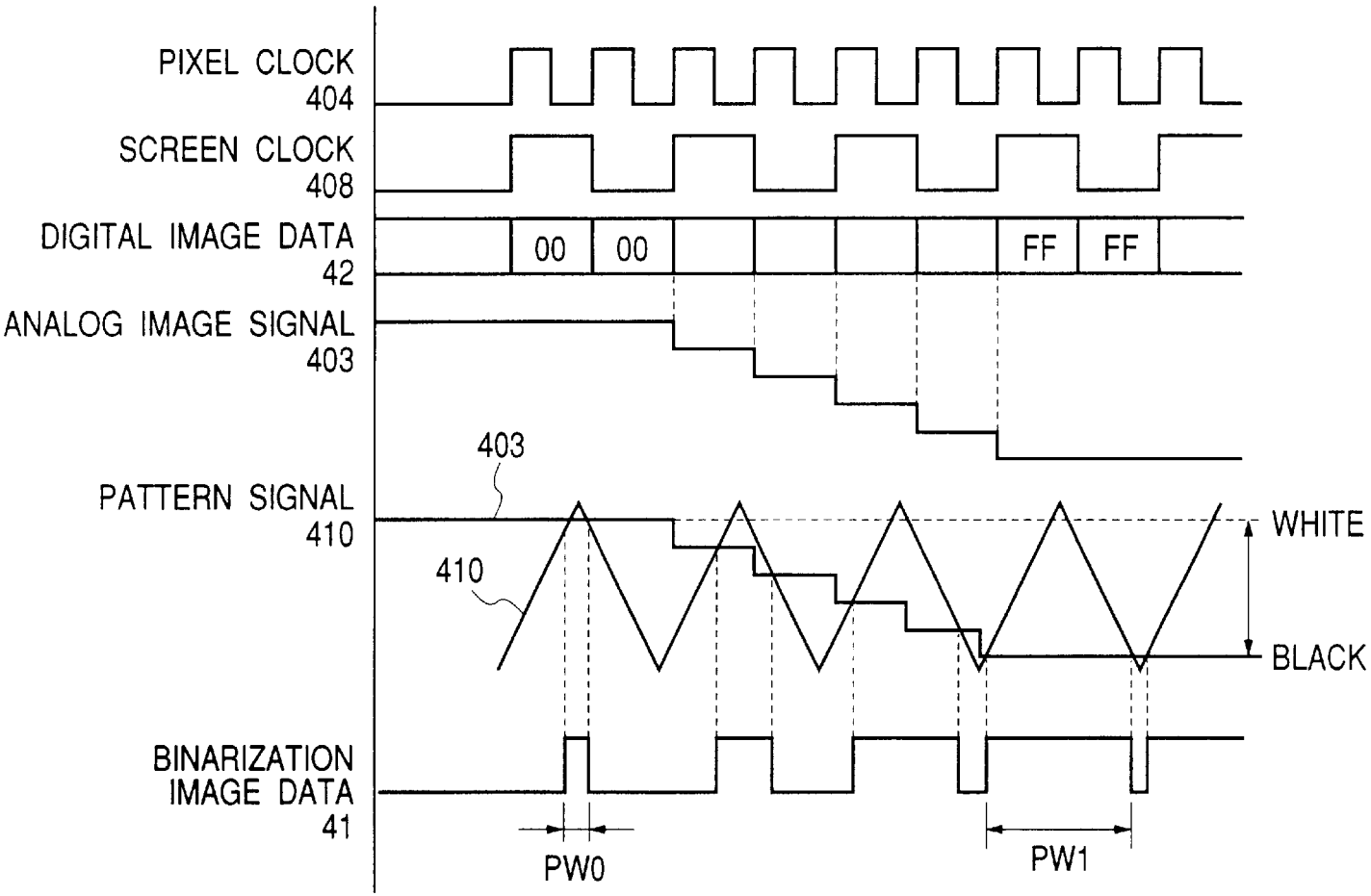
FIG. 10 is a timing chart of the image processing section in FIG. 8.

A timing chart for each section of FIG. 9 is shown in FIG. 10. The image processing process will be described further in reference with this.

Here, the screen clock 408 is stipulated to be a clock having doubled cycle of the pixel clock 404. When the digital image signals change by stages from 00 (white) to FF (black) in the hexadecimal number system, the pattern signals 410 undergo modulation to show a pulse waveform of the binarized image data 41. Thus, changes in amplitude of the pattern signals can change the relationship between input levels of the digital image data 42 and pulse widths of the binarized image data 41.

The binarized image data 41 are inputted into an image forming section of a full color photocopier to control an exposing width of a laser beam so that a laser spot having an exposing width corresponding to the image data is projected onto the photosensitive drum and latent images are formed. These latent images are developed by the above described developing devices 4Y, 4C, 4M, and 4K.

Next, a developing step as a characteristic portion of the present invention will be described in detail. As a developer, a two-component developer made of nonmagnetic toner and magnetic carriers (magnetic particles) is used. A mixing ratio, which is a ratio by weight, for the nonmagnetic toner is set to be approximately 5%. The nonmagnetic toner has a volume average particle diameter of approximately 8 $\mu$m. The magnetic carriers are made of ferrite particles (maximum magnetization of 60 emu/g ($60\times4\pi\times10^{-7}=2.4\pi\times10^{-5}$ Wb.m/kg)) coated with resin, and their weight average particle diameter is 50 $\mu$m, and their resistance value shows a value of not less than $10^8$ Ωcm. In addition, a magnetic permeability of the magnetic carrier is approximately 5.0.

Developing containers of the developing devices 4 (4Y to 4K) are provided with openings in locations adjacent to the photosensitive drum 1, and from these openings developing sleeves as developer carrying bodies protrude outside. The developing sleeves are rotatably incorporated into inside of the developing devices, and are disposed at intervals of 500 $\mu$m toward the photosensitive drum 1. External diameters of the developing sleeves are 25 mm, and their periphery speed is 280 mm/second.

In this embodiment, alternate voltages are applied to intermittently generate an alternate electric field to satisfy the following condition:

$$|Vpp-2Vcont|d\cdot Tb^2<d^2/|Q|,$$

where:

Vpp: a peak-to-peak voltage [V] of an alternate voltage of a developing bias applied to the developer carrying body, Tb: maximum time [second] for an alternate voltage of the developing bias applied to the developer carrying body to bring toner back to the developer carrying body, Vcont: image contrast potential [V] (a potential difference between a DC voltage of the developing bias and latent image potential in the case where maximum image density is outputted, Q: average charging quantity of triboelectricity of toner [C/kg], and d: distance [m] between an image bearing body and a developer carrying body.

As toner used in this embodiment, two kinds of those with tribo charging quantity respectively of approximately $-2.0\times10^2$ C/kg and of approximately $-3.0\times10^2$ C/kg are used.

Figure 11:
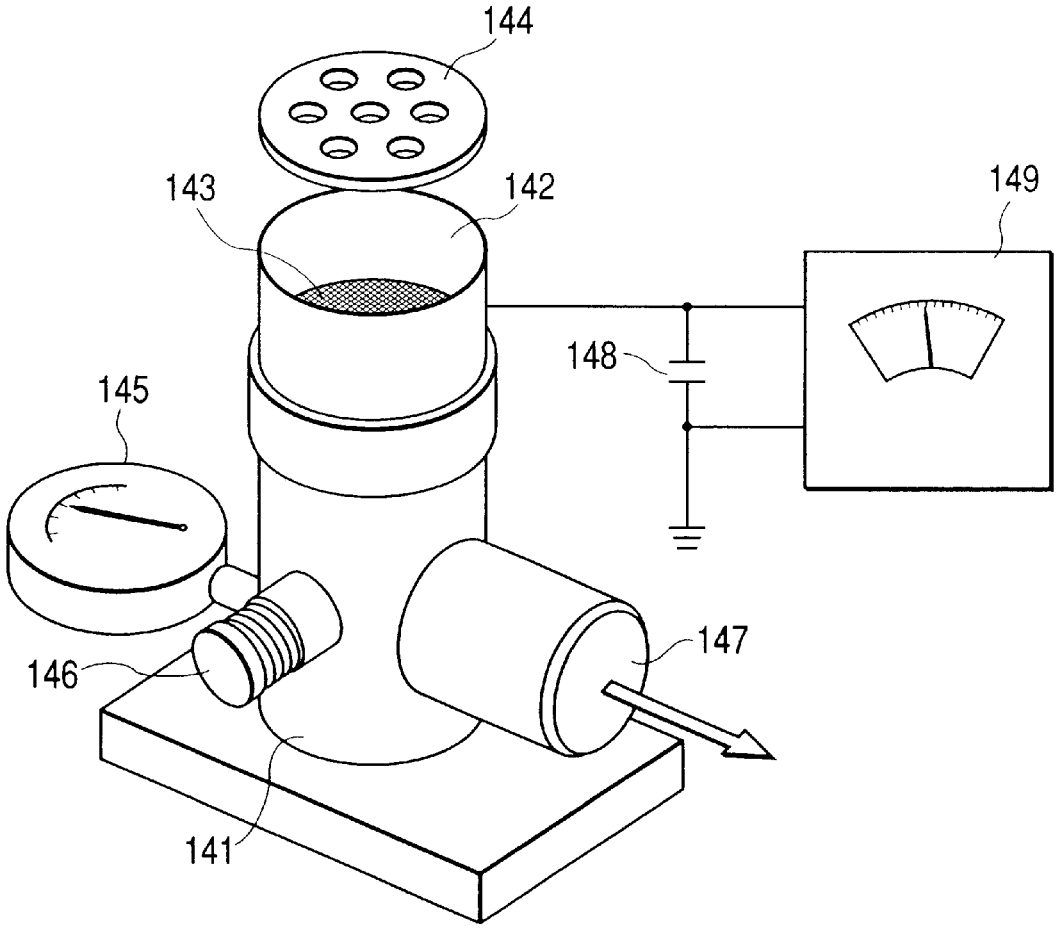
FIG. 11 is a perspective view showing a measuring apparatus for measuring charge quantity of triboelectricity of a toner in a two-component developer.

Next, a measuring method of charging quantity of triboelectricity of toner (two-component developer) will be described with reference to FIG. 11. FIG. 11 shows an apparatus to measure charging quantity of triboelectricity of toner (tribo).

At first, toner, whose charging quantity of triboelectricity is to be measured, is mixed with carriers to form a two-component developer, which is put in a bottle made of polyethylene with a capacity of 50 to 100 ml ($5\times10^{-5}$ to $1\times10^{-4}$ m$^3$), and undergoes swinging with a human hand for approximately 10 to 40 seconds, and subsequently approximately 0.5 to 1.5 g of this developer is put in a measuring container 142 made of metal having a bottom resembling a conductive screen 143 of 500 mesh, and the container 142 is covered with a lid 144 made of metal. The whole weight of the measuring container 142 under this state is measured to be W1 (kg).

Next, the measuring container 142 is installed in an adsorber 141 (having a portion of the adsorber 141 at least brought into contact with the measuring container 142 being an insulator), adsorption is implemented from an adsorption orifice 147 and a ventilation adjusting valve 146 is adjusted to set pressure of the vacuum meter 145 at 250 mmAq ($0.25\times9806.65\cong2.45\times10^3$ Pa). Under this state, adsorption is implemented for ten minutes and preferably for two minutes so that toner is adsorbed and removed. Potential at which the potentiometer 149 is brought into connection with the measuring container 142 at this time is read and this is denoted as V1 (V). In addition, whole weight of the measuring container 142 after adsorption is measured and this is denoted as W2 (kg). With capacity of a capacitor 148 brought into connection with the measuring container 142 in parallel along the potentiometer 149 being denoted as C1 ($\mu$F), charging quantity of triboelectricity is calculated such as in a following equation:

Charging quantity of triboelectricity of toner ($\mu$C/kg)= $C1\times V1\times10^{-3}/(W1-W2)$.

In this embodiment, a highlight halftone image with an image density of approximately around 0.2 and a solid image are outputted so that smoothness of the highlight halftone image and a density of the solid image are assessed.

Here, forming of an electrostatic latent image for an image output is as follows. At first, the photosensitive drum undergoes charging uniformly at −650 V, and in the case where a highlight half tone image is outputted, PWM (pulse width modulation) is implemented by a semiconductor laser so that surface potential is caused to drop to reach approximately −450 V, and in the case where a solid image is outputted, to reach approximately −150 V (Vcont=350 V).

Figure 12:
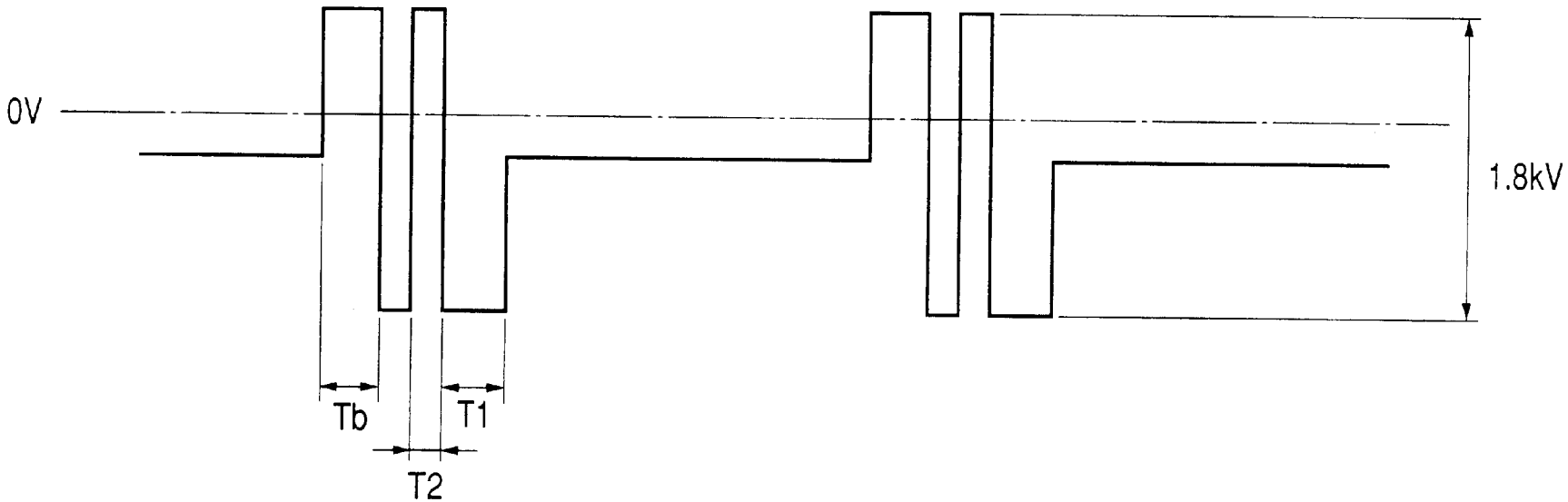
FIG. 12 is a waveform diagram showing a BP bias used in the embodiment in FIG. 8.

Subsequently, toner having a developing device with the above described configuration as well as quantity of charging is used to develop a latent image by means of a reversal developing method. In this embodiment, a direct voltage of the developing bias is set at −500 V, an amplitude Vpp of an alternate voltage given intermittently is fixed at 1800 V, and maximum time Tb of bring-back time is changed. At this time, time period for absence of alternate electric field is, as shown in FIG. 12, set at time equivalent to 2 cycles for every cycle of alternate electric field. Developer is two-component developer, and for toner thereof the above described two kinds of toner (with tribo charging quantity respectively of approximately $-2.0\times10^2$ C/kg and of approximately $-3.0\times10^2$ C/kg) have been tested. Results are shown in Table 1.

As shown in Table 1, in $A=|Vpp-2Vcont|\cdot Tb^2/4$, $B=d^2/|Q|$, only when these relationships comply with A<B, a high density is maintained in a solid state and moreover reproducing performance is good.

TABLE 1

| Toner charging quantity | Tb = T1 | Solid image | Highlight image | $A=\frac{\lvert Vpp-2Vcont\rvert Tb^2}{4}$ | $B=\frac{d^2}{\lvert Q\rvert}$ | |
|---|---|---|---|---|---|---|
| $-2.0\times10^{-2}$ C/kg | 500 $\mu$s | 1.55 | Fail | $6.9\times10^{-5}$ | $1.3\times10^{-5}$ | A > B |
| | 250 $\mu$s | 1.58 | Fair | $1.7\times10^{-5}$ | $1.3\times10^{-5}$ | A > B |
| | 125 $\mu$s | 1.64 | Excellent | $4.3\times10^{-6}$ | $1.3\times10^{-5}$ | B > A |
| | 62.5 $\mu$s | 1.75 | Excellent | $1.1\times10^{-6}$ | $1.3\times10^{-5}$ | B > A |

TABLE 1-continued

| Toner charging quantity | Tb = T1 | Solid image | Highlight image | $A = \frac{\lvert Vpp - 2Vcont \rvert Tb^2}{4}$ | $B = \frac{d^2}{\lvert Q \rvert}$ | |
|---|---|---|---|---|---|---|
| $-3.0 \times 10^{-2}$ C/kg | 500 μs | 1.48 | Fail | $6.9 \times 10^{-5}$ | $8.3 \times 10^{-6}$ | A > B |
| | 250 μs | 1.51 | Fair | $1.7 \times 10^{-5}$ | $8.3 \times 10^{-6}$ | A > B |
| | 125 μs | 1.61 | Good | $4.3 \times 10^{-6}$ | $8.3 \times 10^{-6}$ | B > A |
| | 62.5 μs | 1.74 | Excellent | $1.1 \times 10^{-6}$ | $8.3 \times 10^{-6}$ | B > A |

As described above, FIG. 5 and FIG. 6 are drawings showing a force F applied to a toner particle on the developing sleeve, and in the drawing, reference character q denotes a quantity of electric charge of toner, reference character m denotes mass, reference character a denotes acceleration, reference character ΔV denotes a potential difference between the photosensitive drum and the developing sleeve, and reference character d denotes a gap between the photosensitive drum and the developing sleeve.

A distance X for which toner can move from the photosensitive drum and the developing sleeve is given as follows. An exfoliation voltage to bring toner back to the developing sleeve is applied to toner for maximum time of Tb seconds during a period when oscillating electric field is being applied. The distance X for which toner can move during this period is given by the following equation (1):

$$X=|Q|\cdot|1/2\cdot \mathrm{Vpp}-\mathrm{Vcont}|\cdot Tb^2/2d \quad (1)$$

Here, the toner having undergone developing onto the photosensitive drum is set under condition that it is not returned to the developing sleeve for a moving distance X in the case where an exfoliation voltage is applied for the maximum time period so that the toner repeats biased oscillation on the photosensitive drum. A condition at this time is when X becomes smaller than the gap d between the photosensitive drum and the developing sleeve.

The above is expressed by an equation as follows:

$$|Q|\cdot|1/2\cdot \mathrm{Vpp}-\mathrm{Vcont}|\cdot Tb^2/2d \therefore |\mathrm{Vpp}-2\mathrm{vcont}|\cdot Tb^2/4<d^2/|Q| \quad (2)$$

When development is implemented under such a condition, even an electric field with an exfoliation voltage for a maximum time period cannot implement sufficient alternate movement between S and D, moreover an application time period of voltage in the development promoting side immediately before an alternate voltage is made to stand up is extended as described before, and thereby the DC component works so as to attract toner in quantity matching latent image potential to the photosensitive drum even in the case where Vpp is low, no longer giving rise to any lack of dots. In addition, on the photosensitive drum, oscillation is intermittently repeated so that toner is concentrated to the latent image section and every dot is reproduced faithfully, and thus even with such vague latent image from which a conventional rectangular bias can only provide with an uneven image, an uniform image will become available for outputting.

Figure 13:
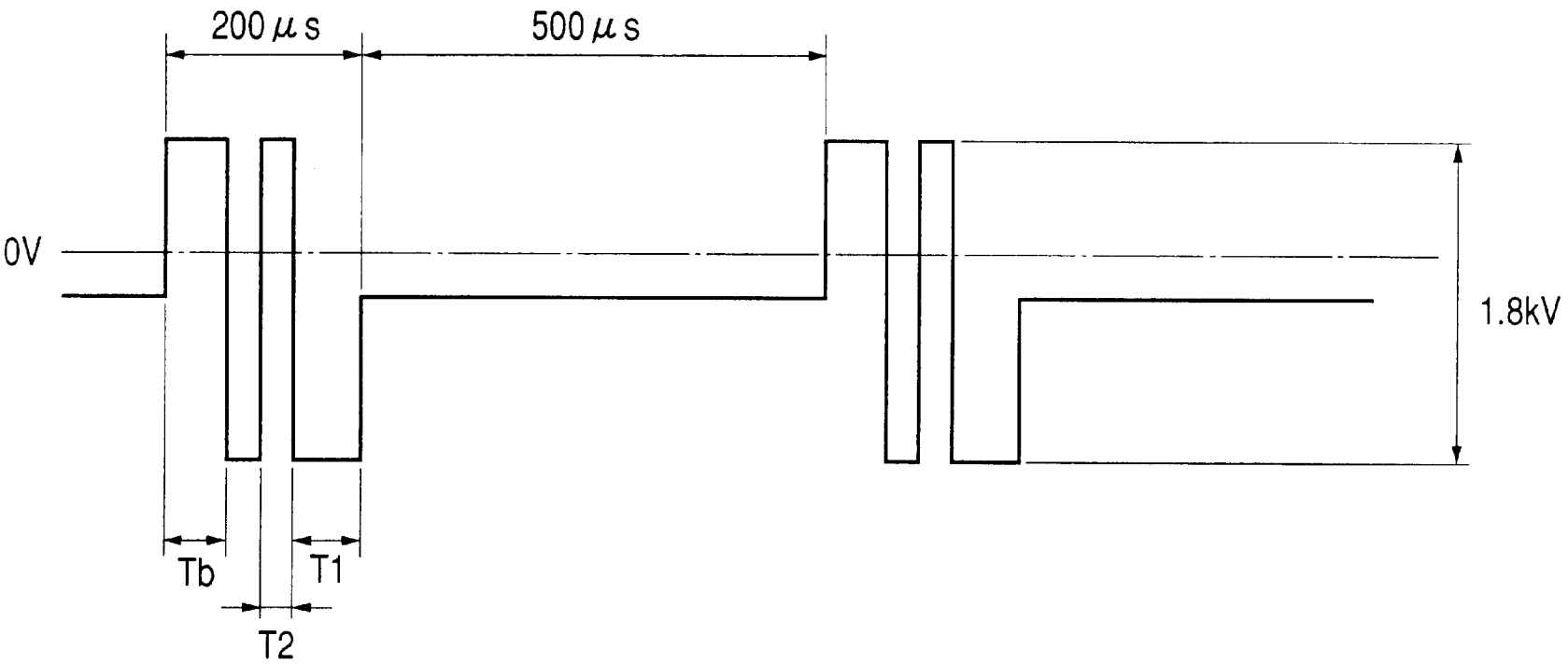
FIG. 13 is a waveform graph showing another example of a BP bias available for use in the present invention.
Figure 14:
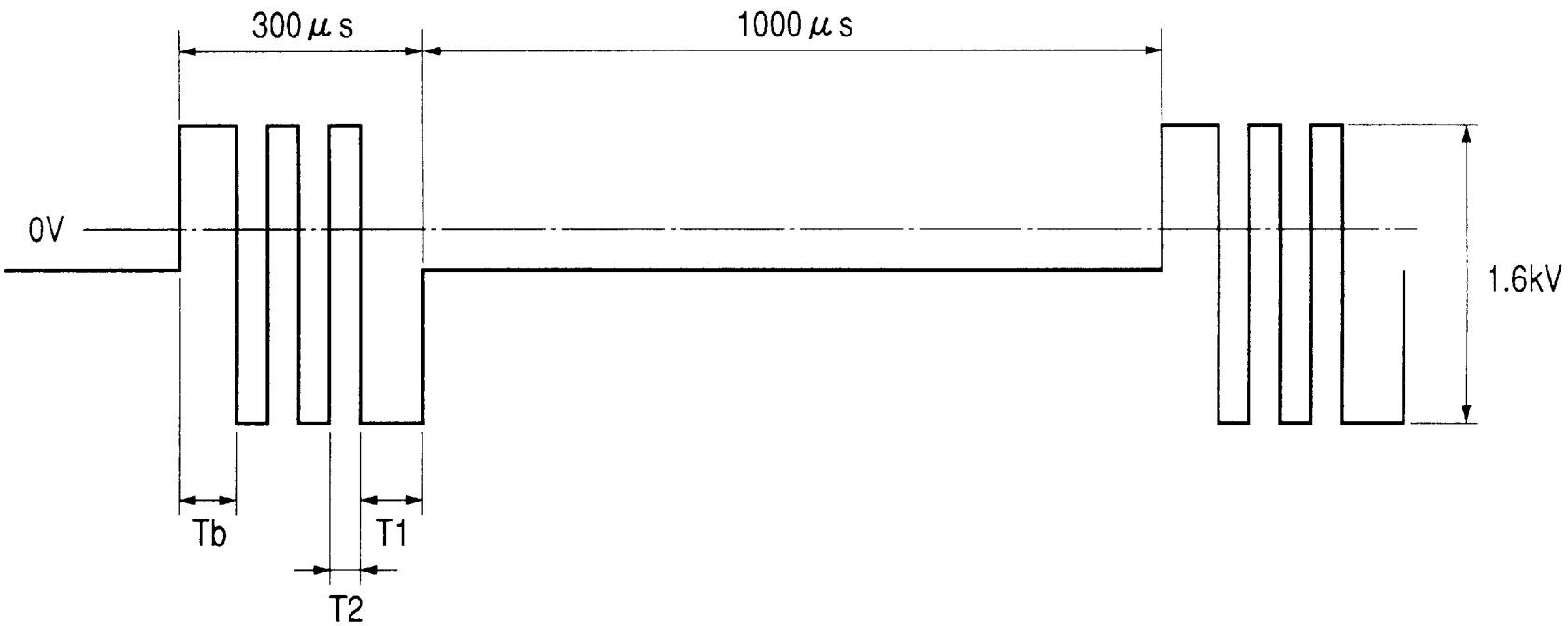
FIG. 14 is a waveform graph showing still another example of a BP bias available for use in the present invention.
Figure 15:
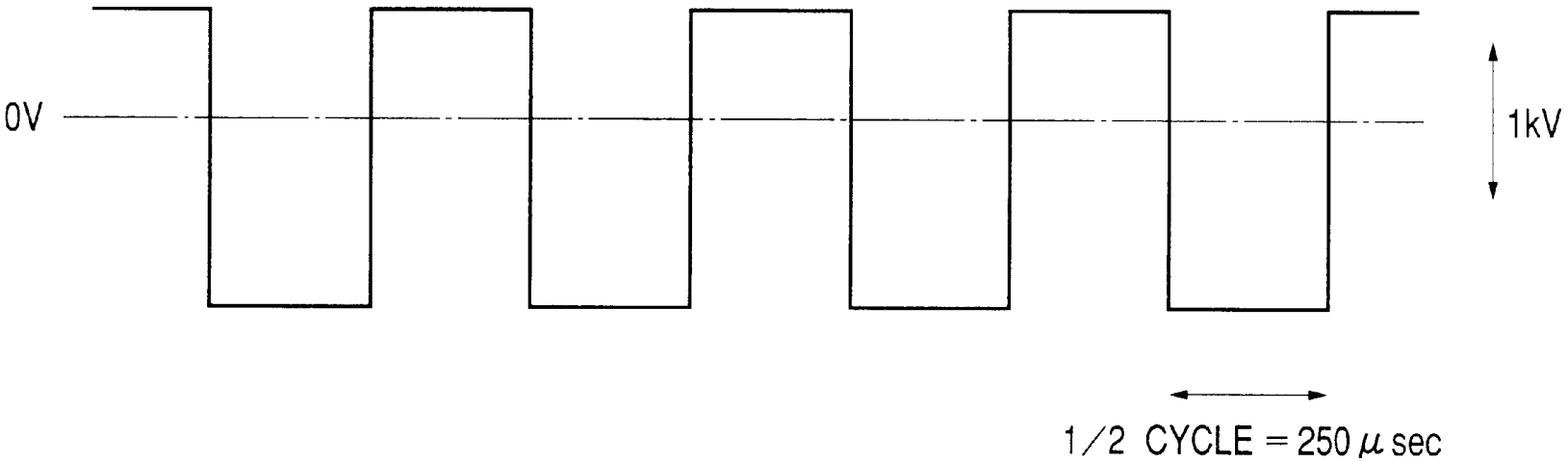
FIG. 15 is a waveform graph showing a rectangular bias.
Figure 16:
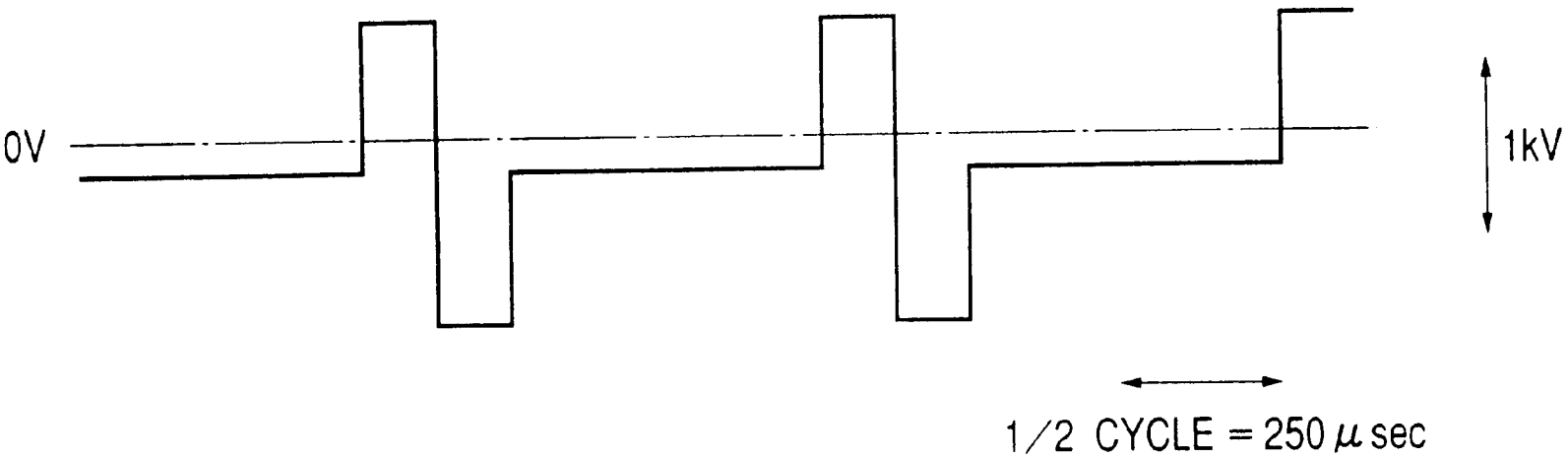
FIG. 16 PRIOR ART
FIG. 16 is waveform graph showing a conventional BP bias.

In this embodiment, an alternating electric field to be applied, that is, a BP bias, is configured as shown in FIG. 12, but the present invention is not limited thereto, and for example as shown in FIG. 13, may be composed with 2 wavelength application and 5 wavelength pause, or as shown in FIG. 14, with 3 wavelength application and 10 wavelength pause. In addition, a waveform of these oscillating portions is not necessarily a rectangular wave, but various waveforms such as a triangular wave and a sine wave, etc. can be applied so that the most appropriate waveform can be selected based on photocopying velocity or developing conditions. In addition, the ratio of a period for bias application to a period for pause is preferably 1:1/2 to 1:15, and good results are obtainable within this range.

As described so far, embodiment of the present invention have been described, but the present invention will not be limited to these embodiments, and within the scope of technical idea of the present invention any variation is possible.

As described so far, in the image forming apparatus of this embodiment, a blank pulse bias comprising an oscillating portion and a pause portion for a waveform cycle is adopted as a developing bias voltage to be applied to a developer carrying body with bias application means, an oscillating bias immediately before shifting from its oscillating portion to the pause portion is directed so as to make toner fly to an image bearing body with T1 being its application time, and an oscillating bias further immediately prior thereto is directed so as to bring toner back to the developer carrying body with T2 being its application time, so that these oscillating biases are caused to comply with a relationship of T1>T2, and thus even under a condition that frequencies are high and peak-to-peak voltages are low, uniformity of image is high and images with a sufficient density are available, without giving rise to any poor image due to an abnormal discharge so that images with a high image quality have become constantly available.

Embodiment 4

Figure 17:
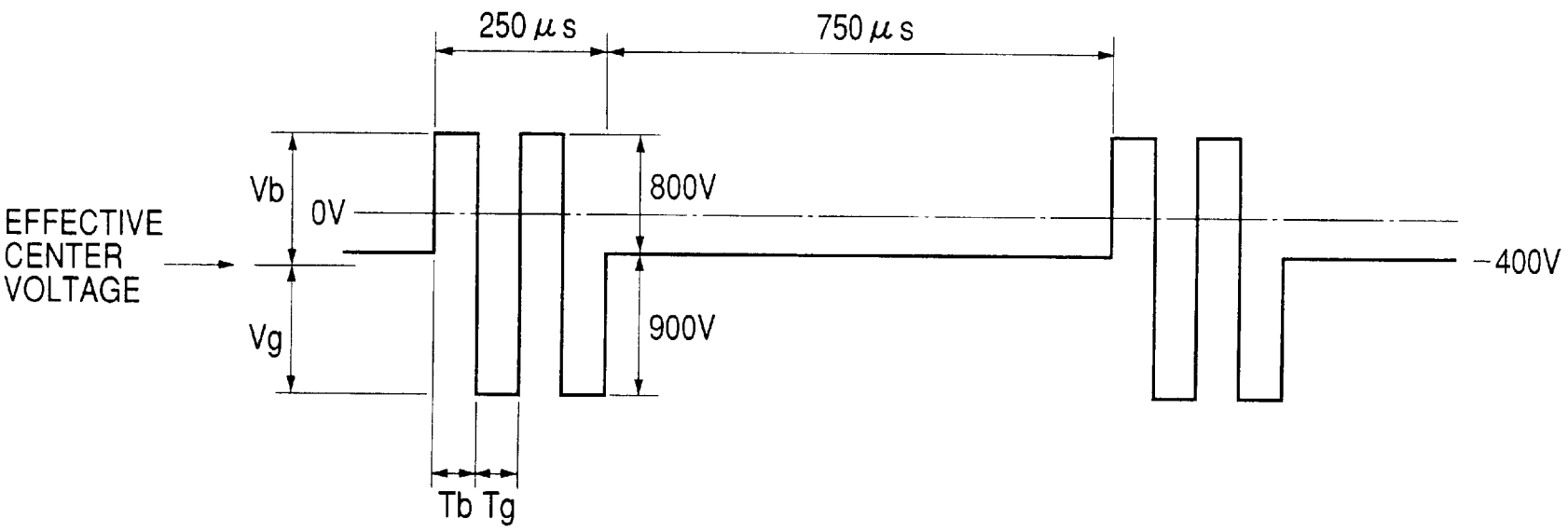
FIG. 17 is a waveform graph showing a BP bias used in the embodiment in FIG. 1.

This embodiment is characterized in that a BP bias is devised so that the BP bias is applied to a developing sleeve (a developer carrying body) of a developing device 133 (4Y to 4K) from a not shown developing power supply being bias applying means as a developing bias at the time of development. A developing bias used in this embodiment is shown in FIG. 17. This developing bias voltage is a BP bias (a blank pulse bias) having a pause portion (a blank portion) and an oscillating portion. The oscillating portion is formed with four pulses and the time period for each pulse Tb=Tg is 62.5 μs (micro seconds), that is, 250 μs for four pulses.

A pulse peak voltage of the oscillating portion is 900 V being a potential difference between the pulse peak voltage (for the time period of Tg) in such a direction to make toner fly to the photosensitive drum 1 and the pause portion, and is 800 V being a potential difference between the pulse peak voltage (for the time period of Tb) in such a direction to bring toner back to the developing sleeve and the pause portion whereas the potential of the pause portion is −400 V. The effective center voltage hereof is approximately −412.5 V. A potential difference Vg between the effective center voltage value of the present bias and the pulse peak voltage in such a direction to make toner of the oscillating portion fly to the photosensitive drum is 887.5 V, a potential difference Vb between the same and the pulse peak voltage in such a direction to bring toner back to the developing sleeve is 812.5 V, and Vg is designed to be bigger than Vb.

Figure 20:
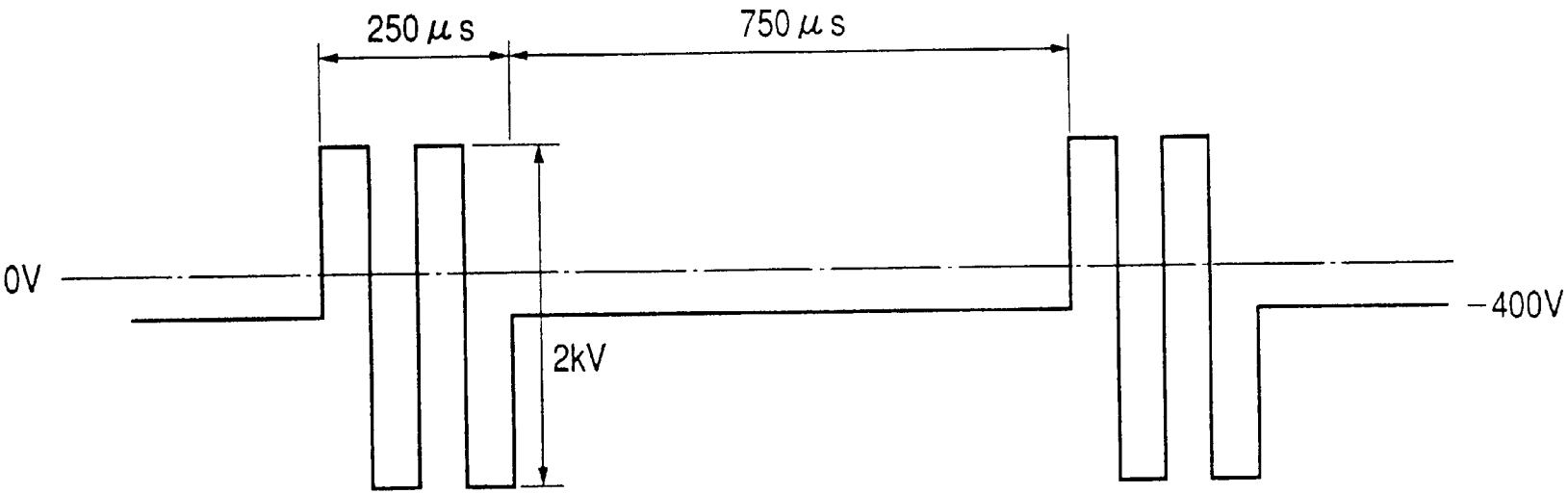
FIG. 20 PRIOR ART
FIG. 20 is a waveform graph showing a conventional BP bias.

In a BP bias that has been proposed conventionally as in FIG. 20, respective pulse peak voltages of the oscillating portion are approximately the same for the peak voltage in such a direction to make toner fly in the direction of the photosensitive drum 1 from potential of the pause portion and the peak voltage in such a direction to bring toner back to the developing sleeve from potential of the pause portion, and for example, for a bias of 2.0 kV being the peak-to-peak voltage Vpp, they are −1 kV and +1 kV respectively. In such a conventional bias, −400 V being the potential of the pause portion will give rise to an effective center voltage of approximately −400 V, resulting in that Vg and Vb become approximately the same.

Figure 18:
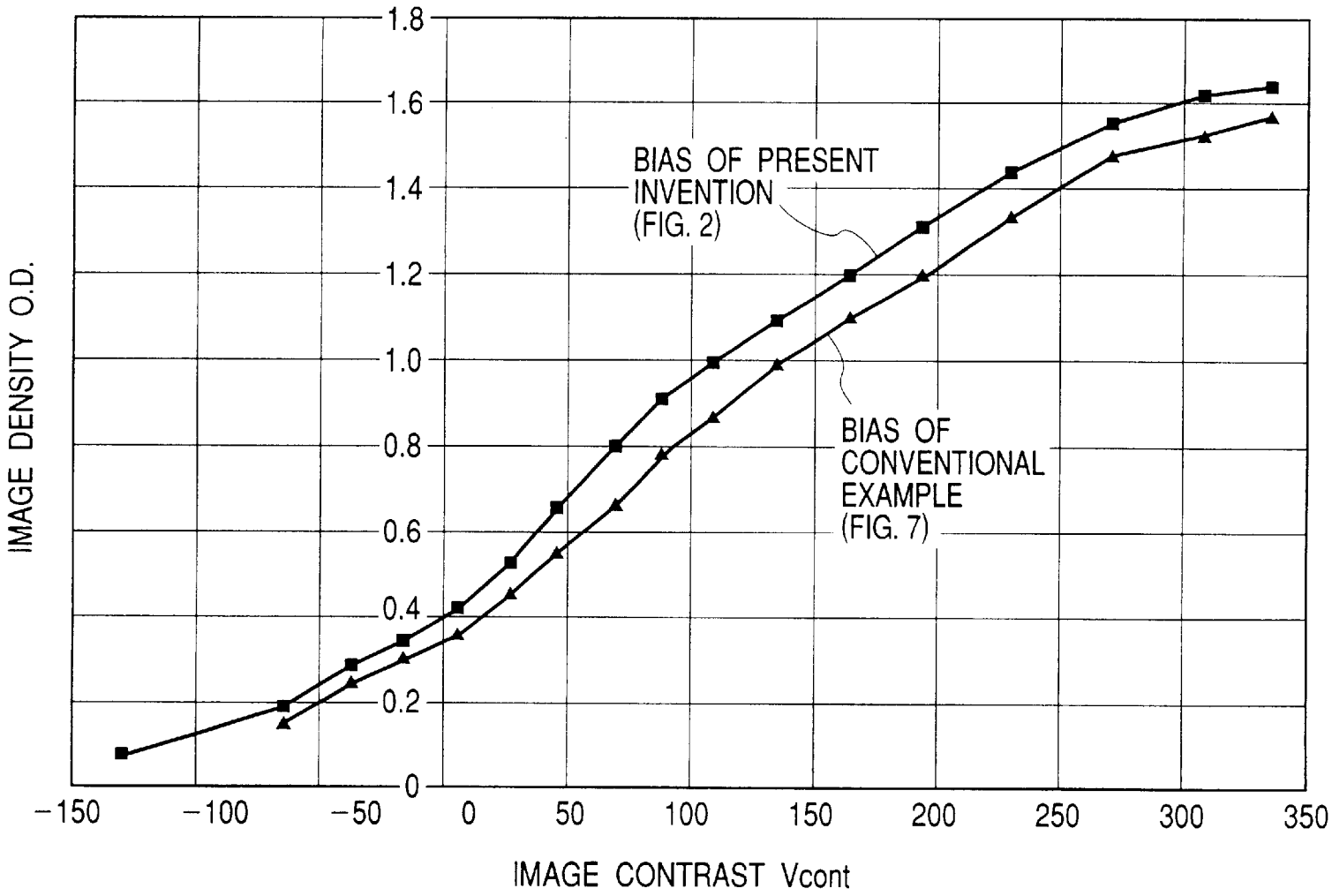
FIG. 18 is a graph showing V-D curves in the case where the biases in FIG. 17 and FIG. 20 are used to output images under the same conditions.

Here, with Vpp of a bias of FIG. 17 being 1.7 kV and with Vpp of a bias of FIG. 20 being 2 kV, V-D (developing contrast vs. image density) curves are shown in FIG. 18 in the case where images are outputted under the same conditions with biases shown in FIG. 17 and FIG. 20.

As shown in FIG. 18, higher density is available from the BP bias of the present invention (FIG. 17) than from the conventional BP bias (FIG. 20). That is, according to the bias of the present invention, a density that used to be conventionally not available unless the Vpp of the BP bias is raised to reach 2 kV becomes sufficiently available even if the Vpp drops to less than 2 kV, in particular, to reach 1.7 kV.

In this embodiment, the Vpp of the BP bias can be controlled to stay at 1.7 kV, and consequently, a foreign substance eventually being mixed into a developing section does not give rise of any poor image due to an abnormal discharge that used to become a problem so that images with a high density are constantly available. In addition, according to the bias of the present invention, an effect enabling to make a coarse image in a highlighted portion being a characteristic of the BP bias less to an extent equivalent to a conventional bias has been obtained.

The BP bias provides good dot reproduction performance in the low contrast section since toner having received oscillating bias in the developing section repeats oscillation between the developing sleeve and the photosensitive drum 1 so that the toner's clinging onto a latent image is implemented faithfully to the latent image, but in the BP bias of the present invention a balance between the difference of a peak voltage in such a direction that makes toner fly to the photosensitive drum to a latent image potential (flying contrast) and the difference of a peak voltage in such a direction that brings toner back to the developing sleeve to a latent image potential (returning contrast) is larger than in a conventional BP bias also in the same latent image potential, and therefore toner is more abundant than in a conventional BP bias and oscillates biased to the photosensitive drum side. This is considered to serve to enable to make density more intensive and Vpp be set low.

Lasting use will deteriorate developer, resulting in reduction of toner having a quantity of charging suitable to development in the developer, so that a conventional BP bias will no longer make a sufficient density available, but the BP bias of the present invention can make a sufficient density available with such a developer.

In addition, in the non-image section, the BP bias of the present invention will have a voltage of the pause portion to be potential in such a direction that brings toner back to the developing sleeve than effective bias center so that fogging onto the photosensitive drum is hardly apt to take place than with a conventional bias.

According to experiments conducted by the present inventors, as the ratio Vg/Vb of the above described Vg (a potential difference between the effective center voltage value and the pulse peak voltage in such a direction to make toner fly to the photosensitive drum) and Vb (a potential difference between the effective center voltage value and the pulse peak voltage in such a direction to bring toner back to the developing sleeve) gets larger as shown in Table 2, the developing density gets more intensive, but when it goes too large, coarseness in a low density section (a highlight image) gets worse.

TABLE 2

| Vg | Vb | Vg/Vb | Solid image density | Highlight image coarseness |
|---|---|---|---|---|
| 1000 V | 1000 V | 1.00 | 1.50 | Good |
| 900 V | 800 V | 1.13 | 1.60 | Good |
| 900 V | 600 V | 1.50 | 1.65 | Good |
| 900 V | 500 V | 1.80 | 1.68 | Fair |
| 900 V | 450 V | 2.00 | 1.70 | Fair |
| 900 V | 400 V | 2.25 | 1.70 | Fail |

Presumably, the reason is that the toner is biased too much to the photosensitive drum side to undergo oscillation sufficiently, leaving the toner having clung to the latent image clinging onto the latent image without undergoing rearrangement, and therefore the image cannot be reproduced faithfully to the latent image.

According to Table 2, Vg/Vb is preferably within the range of $1<Vg/Vb\leqq 1.5$, and this embodiment provides with Vg/Vb=887.5/812.5=approximately 1.09.

In this embodiment, as a developing bias, a BP bias as shown in FIG. 17 is applied to the developing sleeve, but the present invention is not limited hereto, and various BP biases can be used. In this case, in the oscillating portion of the BP bias, with an electric field in such a direction that makes toner fly to the photosensitive drum getting larger than an electric field in such a direction that brings toner back to the developing sleeve, if the application time period Tb of the electric field in such a direction that brings it back is longer than the application time period Tg of the electric field in such a direction that makes it fly, the toner that oscillates biased to the photosensitive drum side gets less, deteriorating the effect of the present invention. Accordingly, it is preferable that Tg is approximately equal to Tb or Tg>Tb.

Since a BP bias, a developing apparatus, and developer suitable to the present invention is the same as in Embodiment 1, a description thereon will be omitted.

Incidentally, in this embodiment, as a developer, a two-component developer made of nonmagnetic toner and magnetic carriers (magnetic particles) is used. A mixing ratio, which is a ratio by weight, for the nonmagnetic toner is adopted to be approximately 5%. The nonmagnetic toner has a volume average particle diameter of approximately 8 $\mu$m. The magnetic carriers are made of ferrite particles (maximum magnetization of 60 emu/g) having undergone resin coating, and their weight average particle diameter is 50 $\mu$m, and their resistant value shows a value not less than $10^8$ Ωcm. In addition, magnetic permeability of the magnetic carrier is approximately 5.0. Charging quantity of triboelectricity of toner is approximately $-2.0\times10^{-2}$ C/kg.

In addition, also in this embodiment, the BP bias as a developing bias to be applied to a developer carrying body of a developing apparatus is caused to fulfill a condition, that is:

$$|Vb-Vcont|\cdot Tb^2/2<d^2/|Q|,$$

so that without enlarging Vpp of the developing bias it can be realized that developing does not bring about coarse images in a low density section and images in a sufficient density in a high density section are obtained.

Embodiment 5

In the Embodiment 4, as a developing bias, the BP bias shown in FIG. 17 is used, but as described above, a bias effective for the present invention is not limited hereto.

Figure 19:
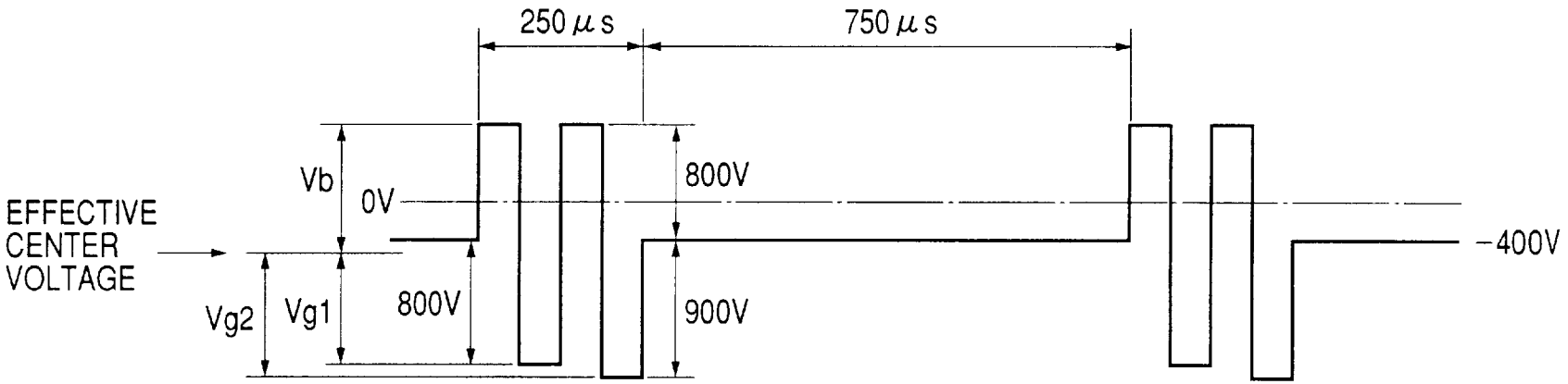
FIG. 19 is a waveform graph showing a BP bias used in another embodiment of the present invention.

A BP bias used for a developing bias in this embodiment is shown in FIG. 19. A pulse peak voltage of an oscillating portion of a BP bias of this embodiment is 800 V being a potential difference between the pulse peak voltage (for the time period of Tb) in such a direction to bring toner back to the developing sleeve and the pause portion, and is 800 V being a potential difference between the pulse peak voltage (for the time period of Tg) in such a direction to make toner fly to the photosensitive drum 1 and the pause portion, but is designed to be 900 V being a potential difference between the pulse peak voltage (for the time period of Tg) in such a direction to make toner immediately prior to shifting from the oscillating portion to the pause portion fly to the photosensitive drum 1 and the pause portion.

With −400 V being potential of the pause portion, the effective center voltage value of this bias is approximately −408 V, and the potential difference Vg2 between this effective center voltage value and the pulse peak voltage in such a direction that makes toner of the oscillating portion immediately prior to shifting from the oscillating portion to the pause portion fly to the photosensitive drum is 892 V, but the potential difference Vg1 between the same and the pulse peak voltage in such a direction that makes the first toner of the oscillating portion fly to the photosensitive drum and the potential difference Vb between the same and the pulse peak voltage in such a direction that brings the toner back to the developing sleeve are 808 V fulfilling Vg1=Vb.

For obtaining a sufficient density by developing, it is necessary to bias much toner to the photosensitive drum side immediately prior to the pause portion to oscillate it, and as this embodiment, causing the electric filed in the direction of flying immediately prior to the pause portion to get larger than the electric field in the return direction prior to the pause portion makes a sufficient density available.

In addition, thus, adoption of only one pulse being given large potential will reduce the ratio that an abnormal discharge takes place in that portion and suppress occurrence of such an abnormal image that deteriorates image quality in the case where a conductive foreign substance is mixed into the developing section more than in the case of adoption of both of two pulses being given large potential as in Embodiment 1.

As described so far, embodiment of the present invention have been described, but the present invention will not be limited to these embodiments, and within the scope of technical idea of the present invention any variation is possible.

As described so far, in the image forming apparatus of this embodiment, a blank pulse bias comprising an oscillating portion and a pause portion for a waveform cycle is adopted as a developing bias voltage to be applied to a developer carrying body with bias application means, a potential difference Vg between an effective center voltage of that bias voltage and a peak voltage in such a direction of flying in the oscillating portion is made larger than a potential difference Vb between the effective center voltage of the bias voltage and a peak voltage in a return direction of the oscillating portion, and thus even under a condition that frequencies are high and peak-to-peak voltages are low, uniformity of image is high and images with a sufficient density are available, without giving rise to any poor image due to an abnormal discharge so that images with a high image quality have become constantly available.

Embodiment 6

This embodiment is characterized in that a BP bias is devised so that the BP bias is applied to a developing sleeve (a developer carrying body) 133*a* of a developing device 133 from a not shown developing power supply being bias applying means as a developing bias at the time of development.

Figure 21:
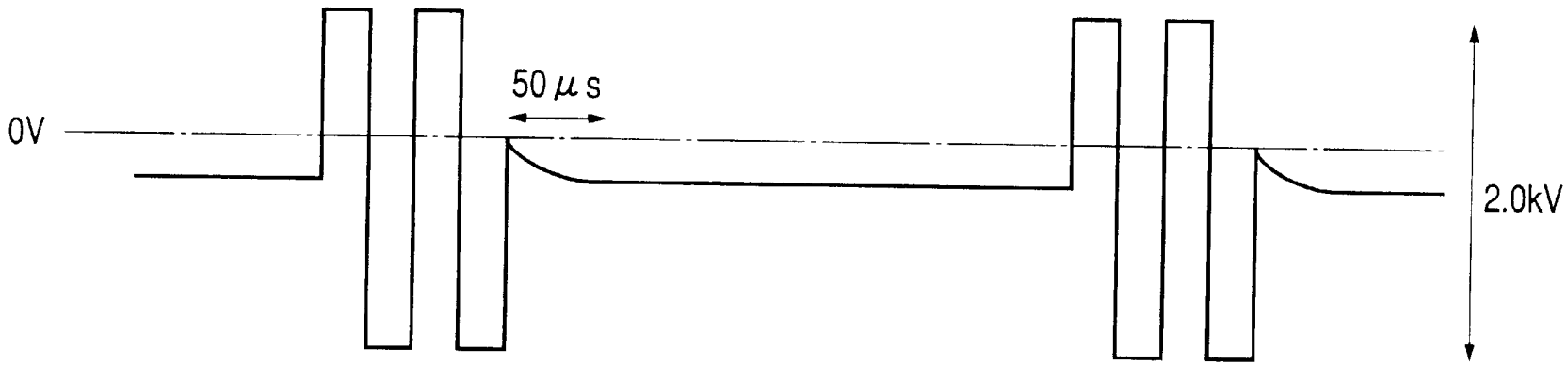
FIG. 21 is a waveform graph showing an actual waveform of a BP bias.

Confirmation of a conventional BP bias waveform that is used in a photocopier CLC1000, etc. manufactured by Canon with an oscilloscope, etc. has revealed that as shown FIG. 21, during shifting from an oscillating portion to a pause portion, developing sleeve potential undergoes overshooting for around 50 μs (micro seconds) passing blank potential.

Figure 22:
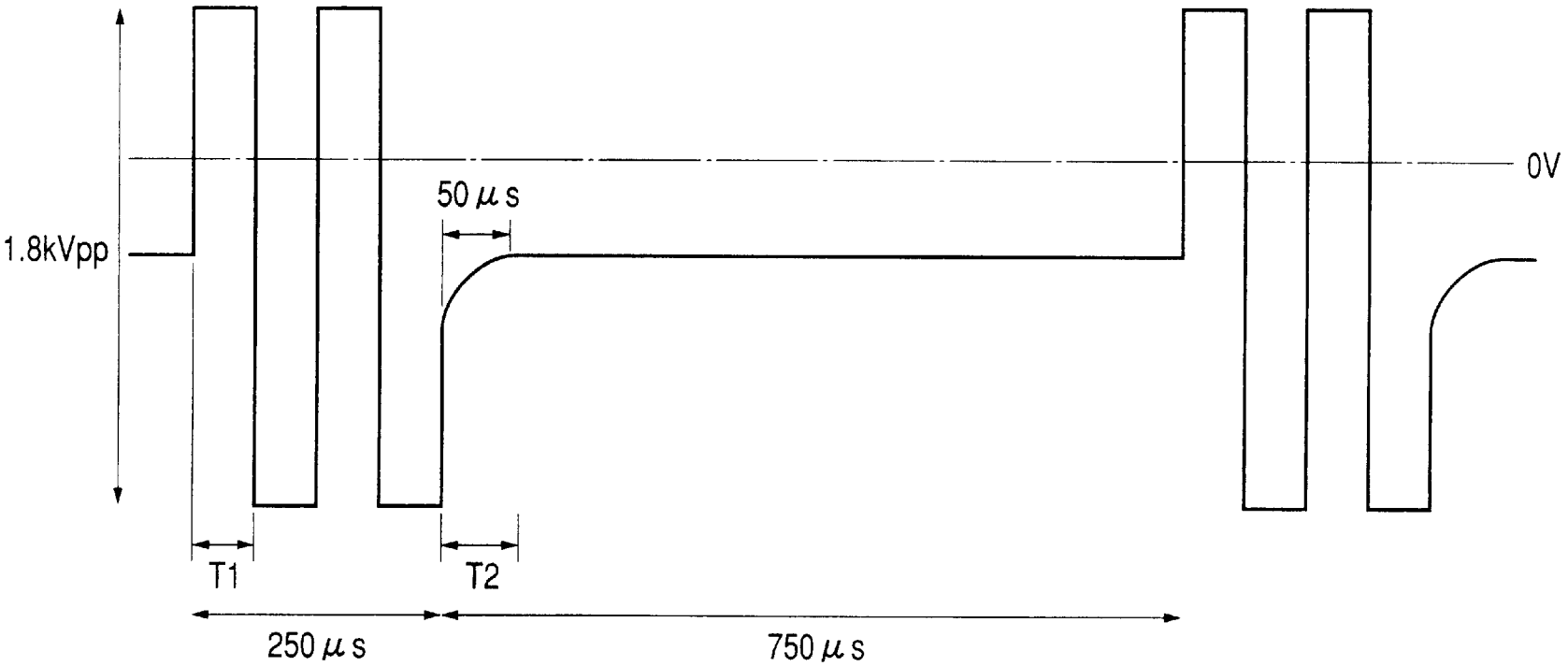
FIG. 22 is a waveform graph showing a BP bias used in the embodiment.

Under the circumstances, in this embodiment, such a BP bias as shown in FIG. 22 has been prepared so that it gradually reaches the pause portion without the developing sleeve potential undergoing overshoot passing the blank potential during shifting from the oscillating portion to the pause portion.

In particular, the BP bias of this embodiment has the oscillating portion formed with four pulses, and 900V is applied immediately after the pause portion as a electric field to bring toner back to the developer carrying body, and −900 V is applied toward the blank potential (pause portion potential), and moreover 900 V is applied toward the blank potential, and at last −900 V is applied in such a direction that makes the toner fly to the photosensitive drum 1 being the image bearing body, thereafter being followed by the pause portion.

The above described BP bias undergoes gradual connection, as a characteristic of the present invention, from the oscillating portion to the pause portion for a time period T2=50 μs. The time period of T1 for each pulse is 62.5 μs, that is, 250 μs for four pulses. In addition, in this embodiment, the pause portion is set by T1×12, that is 750 μs, giving rise to a bias of 1 kHz for a cycle.

Figure 23:
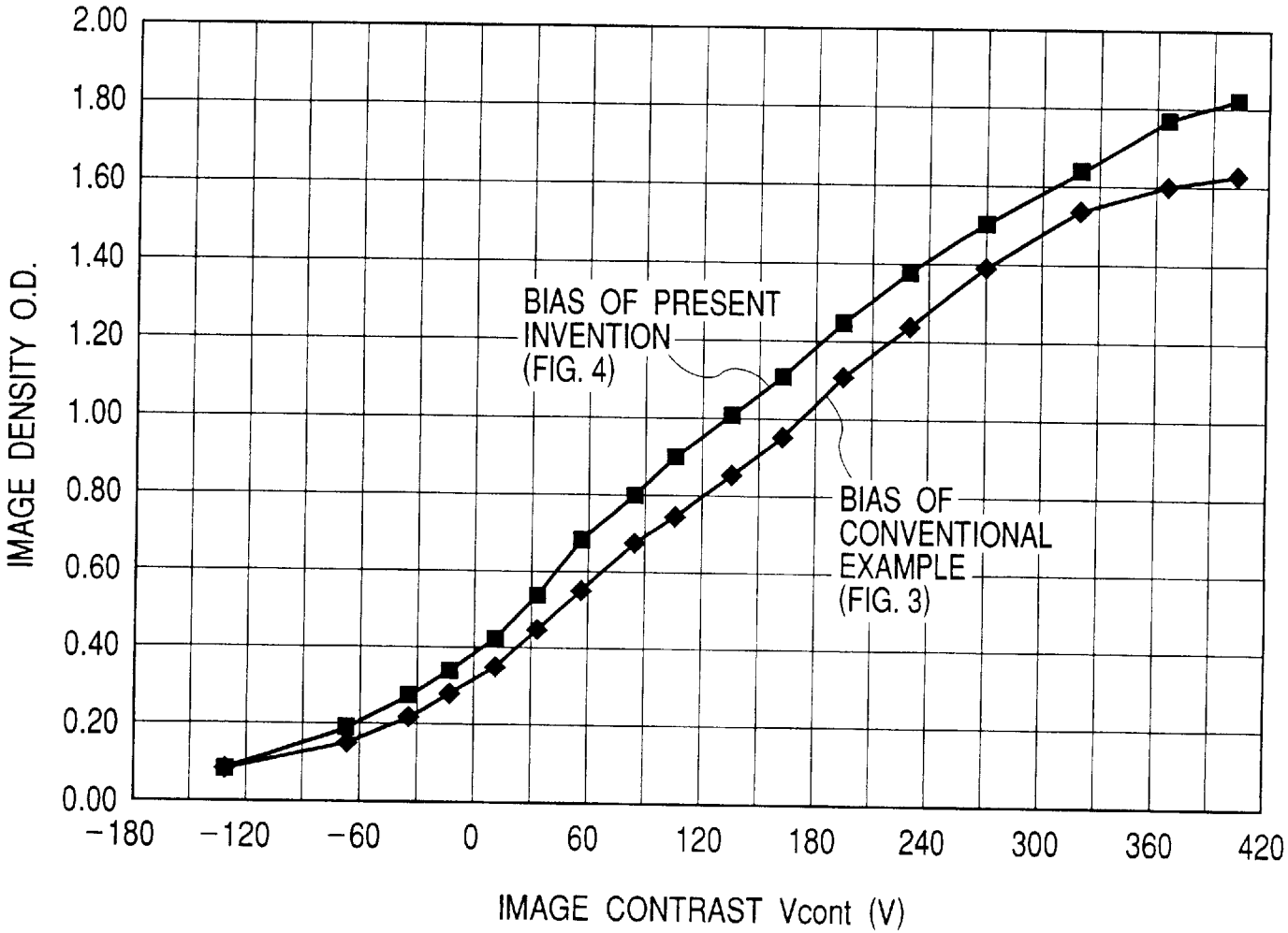
FIG. 23 is a graph showing a V-D curve in the case where the biases in FIG. 21 and FIG. 22 are used to output images under the same conditions.

Here, in FIG. 23, V-D (developing contrast vs. image density) curves are shown in the case where images are outputted under the same conditions with biases of FIG. 21 and FIG. 22. As shown in FIG. 23, it has been confirmed that, according to the BP bias (the bias of FIG. 22) of this embodiment, there takes place no drop in developing performance due to overshoot as in the conventional BP bias (the bias of FIG. 21).

In view of this phenomena of drop in developing performance due to overshoot of potential, the oscillating portion in the BP bias makes the toner having clung on the developing sleeve by reflection force, etc. fly and moreover operates to give acceleration thereto. The pause portion serves to cause the toner accelerated in the oscillating portion to cling at developing contrast potential (=blank potential—latent image potential) formed on the photosensitive drum, but in the overshoot section, since there takes place a state where the developing contrast potential gets small, it is predicted that developing efficiency will drop.

This has been confirmed with another experiment. Firstly, considering completion of the developing process, a state of completion of the developing process is considered to be synonymous with a state where potential (charging potential) on the toner layer of a toner image on the photosensitive drum reaches the same potential as potential (blank potential) on the developing sleeve. Under these circumstances, an experimental apparatus shown in FIG. 24, configured by remodeling the image forming apparatus has been used to conduct a confirmation experiment.

Figure 24:
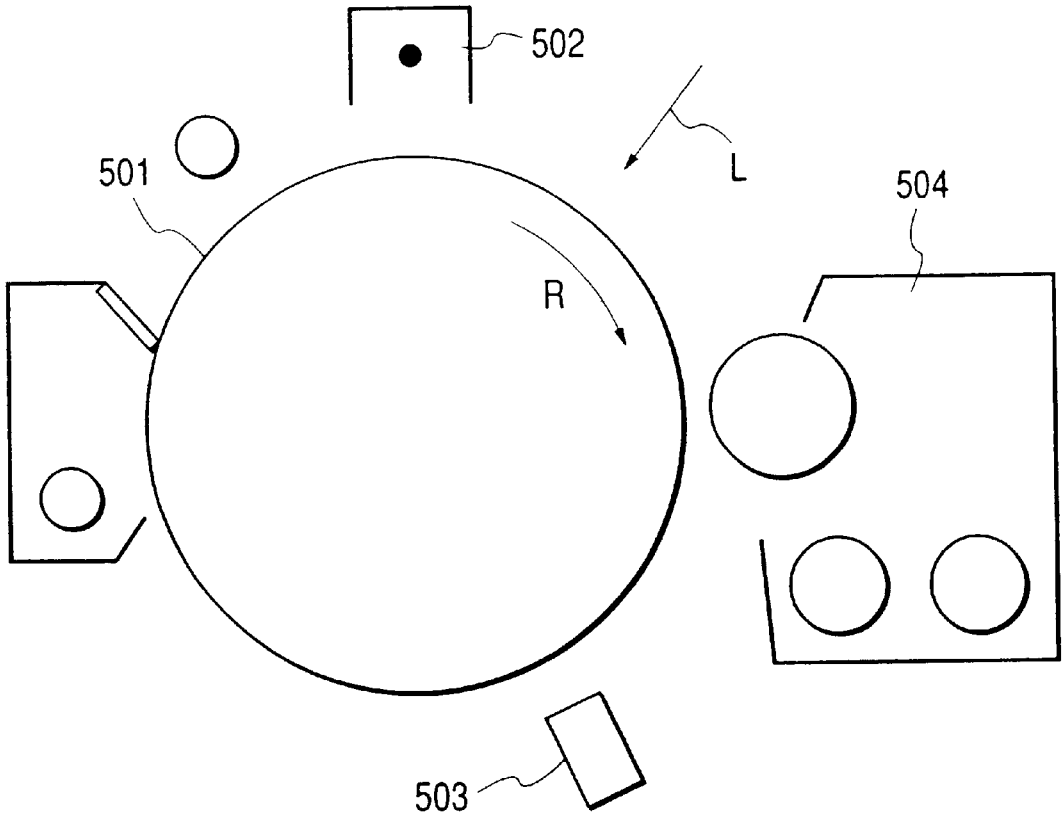
FIG. 24 is a schematic view showing an experimental apparatus used to confirm a drop in developing performance in an overshoot portion of a bias by measuring charging potential of a toner layer in the present invention.

The experiment was conducted by uniformly charging with a charger 502 the surface of a photosensitive drum 501 rotating in the arrowed direction of R in FIG. 24, forming on the photosensitive drum 501 an electrostatic latent image undergoing exposure to 17 gradation potential with a laser beam L, developing that latent image with two-composition developer by the developing device 504, measuring with a potential sensor 503 potential (charging potential) on a toner layer of the 17 gradation toner image formed on the photosensitive drum 501, and comparing its developing performance. Results are shown in FIG. 25.

Figure 25:
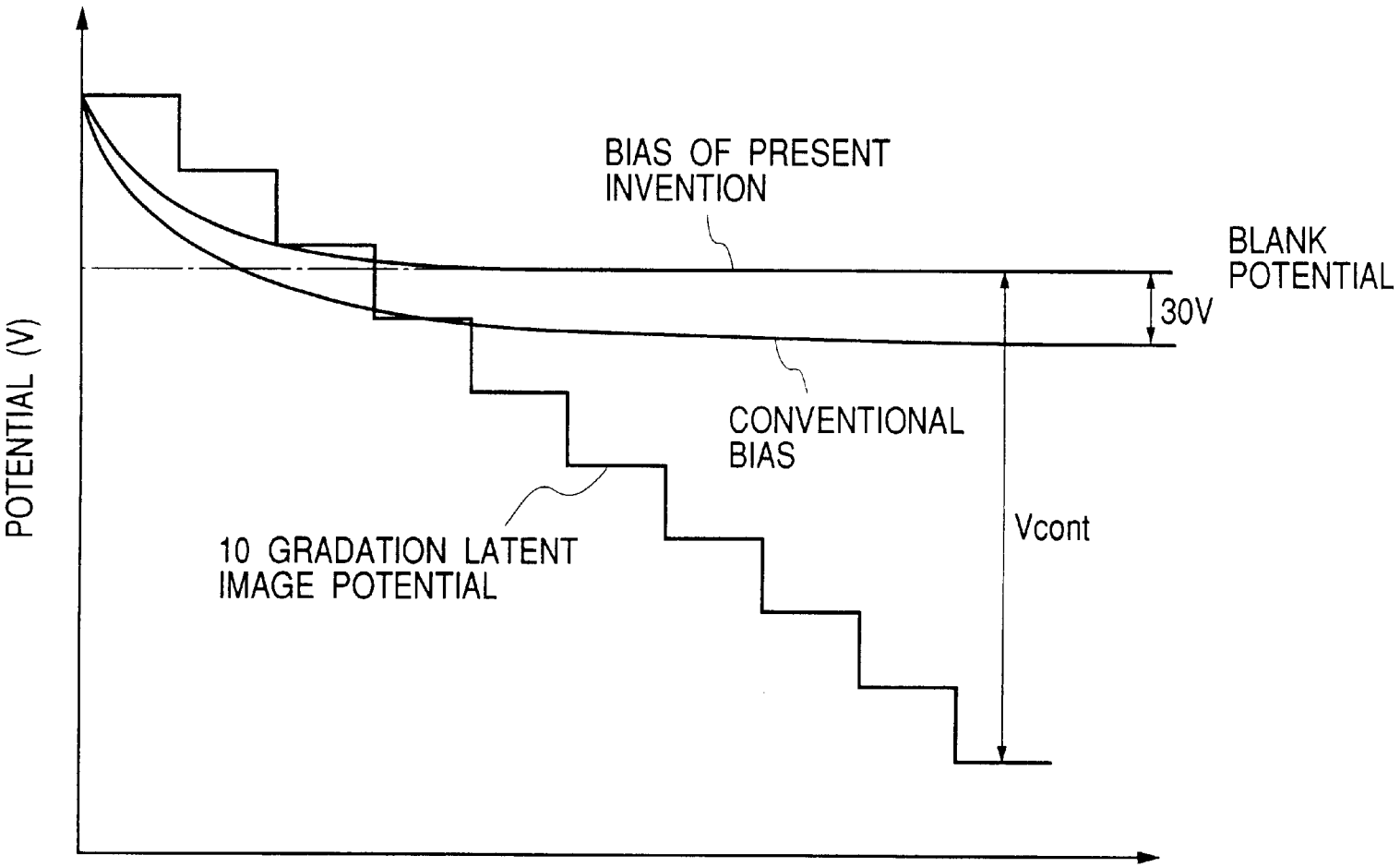
FIG. 25 is a graph showing latent image potential covering 10 gradations as well as charging potential by biases in FIG. 21 and FIG. 22.

FIG. 25 is to show latent image potential covering 10 gradations among 17 gradations and charging potential by each of the conventional bias (FIG. 21) and the bias of the present invention (FIG. 22). As obvious from FIG. 25, it is understood that in the conventional bias in FIG. 21, charging potential does not reach blank portion potential. In addition, from the results of the above described V-D characteristic being correspondent, it is understood that developing performance in the overshoot section is deteriorated.

Under these circumstances, a relationship between the bias waveform at the time when a shape of an image linking portion in the oscillating portion and the pause portion was changed and charging efficience (=charging potential/blank portion potential) was examined. In particular, results taking the time period (denoted as T2) from the oscillating portion to the pause portion as a parameter are shown in Table 3. In Table 3, the negative value of T2 means the time period of overshoot.

TABLE 3

| T2 | −50 μs | 10 μs | 50 μs | 100 μs | 200 μs |
|---|---|---|---|---|---|
| Charging efficiency | 92% | 95% | 100% | 100% | 100% |
| Level of fogged image on background | Good | Good | Good | Good to Fair | Fair |

As is obvious from Table 3, extension of the time period T2 improves developing performance (charging potential) of the solid section, but in the present experiment, effects were saturated for not less than 50 μs, and on the contrary, fogged images on background were brought about on a white surface. This is considered to be an undesirable effect that improvement in developing performance for a solid portion due to availability of large developing contrast potential during the time period of T2, nevertheless, leads to a drop in fogged image removing potential in the white portion. Accordingly, for the present study, T2 of around 50 μs was determined to be preferable.

For a conventional BP bias, in order to attain effects of the pause portion, a ratio of the oscillating portion time period to the pause portion time period of not less than 1:4 is necessary, but as in this embodiment, during shifting from the oscillating portion to the pause portion, adoption of a bias in which the developing sleeve potential reaches the pause portion without undergoing overshoot toward the blank portion potential makes like effects available even with the ratio of the oscillating portion time period to the pause portion time period of 1:1/2.

From what has been described so far, use of such a waveform that gradually reaches the pause portion during shifting from the oscillating portion to the pause portion without the developing sleeve potential's overshoot toward the blank potential enables an image density that used to be conventionally not available unless the peak-to-peak voltage Vpp is raised to reach 2 kV to become sufficiently available even if the Vpp drops to reach 1.8 kV.

In this embodiment, the Vpp of the BP bias can be controlled to stay at 1.8 kV, and consequently, a foreign substance eventually being mixed into a developing section does not give rise to any poor image due to an abnormal discharge that used to become a problem so that images with a high density are constantly available.

Embodiment 7

In the Embodiment 6, as a developing bias, the BP bias shown in FIG. 22 is used, but a bias effective for the present invention is not limited hereto.

A BP bias, a developing apparatus, and developer suitable to the present invention will be described.

In this embodiment, as a developer, a two-component developer made of nonmagnetic toner and magnetic carriers (magnetic particles) is used. A mixing ratio, which is a ratio by weight, for the nonmagnetic toner is adopted to be approximately 5%. The nonmagnetic toner has a volume average particle diameter of approximately 8 μm. The magnetic carriers are made of ferrite particles (maximum magnetization of 60 emu/g) having undergone resin coating, and their weight average particle diameter is 50 μm, and their resistant value shows a value not less than $10^8$ Ωcm. In addition, magnetic permeability of the magnetic carrier is approximately 5.0. A charging quantity of triboelectricity of toner is approximately $-2.0\times10^{-2}$ C/kg.

Developing device 113 is provided with an opening section in the location adjacent to the photosensitive drum 131 of a developing containers in which two-component developer is housed, and from this opening section a developing sleeve as a developer carrying body protrudes outside. The developing sleeve is rotatably incorporated into inside the developing device, and is disposed at an interval of 500 μm toward the photosensitive drum 131. External diameter of the developing sleeve is 25 mm, and its periphery speed is 280 mm/second.

In this embodiment, as a developing bias, alternate voltages are applied to intermittently generate an alternate electric field to fulfill a following condition:

$$|Vpp-2Vcont|\cdot Tb^2/4<d^2/|Q|,$$

wherein:

Vpp: a peak-to-peak voltage [V] of an alternate voltage applied to the developer carrying body, Tb: maximum time [second] for an alternate voltage applied to the developer carrying body to bring toner back to the developer carrying body, Vcont: image contrast potential [V] (a potential difference between a DC voltage of the developing bias and latent image potential in the case where maximum image density is outputted, Q: average charging quantity of triboelectricity of toner [C/kg], and d: distance [m] between an image bearing body and a developer carrying body.

In this embodiment, a highlight halftone image with an image density of approximately around 0.2 and a solid image was outputted so that an experiment was conducted to assess an image based on smoothness of the highlight halftone image and a density of the solid image.

As a result, in $A=|Vpp-2Vcont|\cdot Tb^2/4$, $B=d^2/|Q|$, only when these relationships comply with A<B, a high density is maintained in a solid state and moreover reproducing performance of highlight is good.

Figure 26:
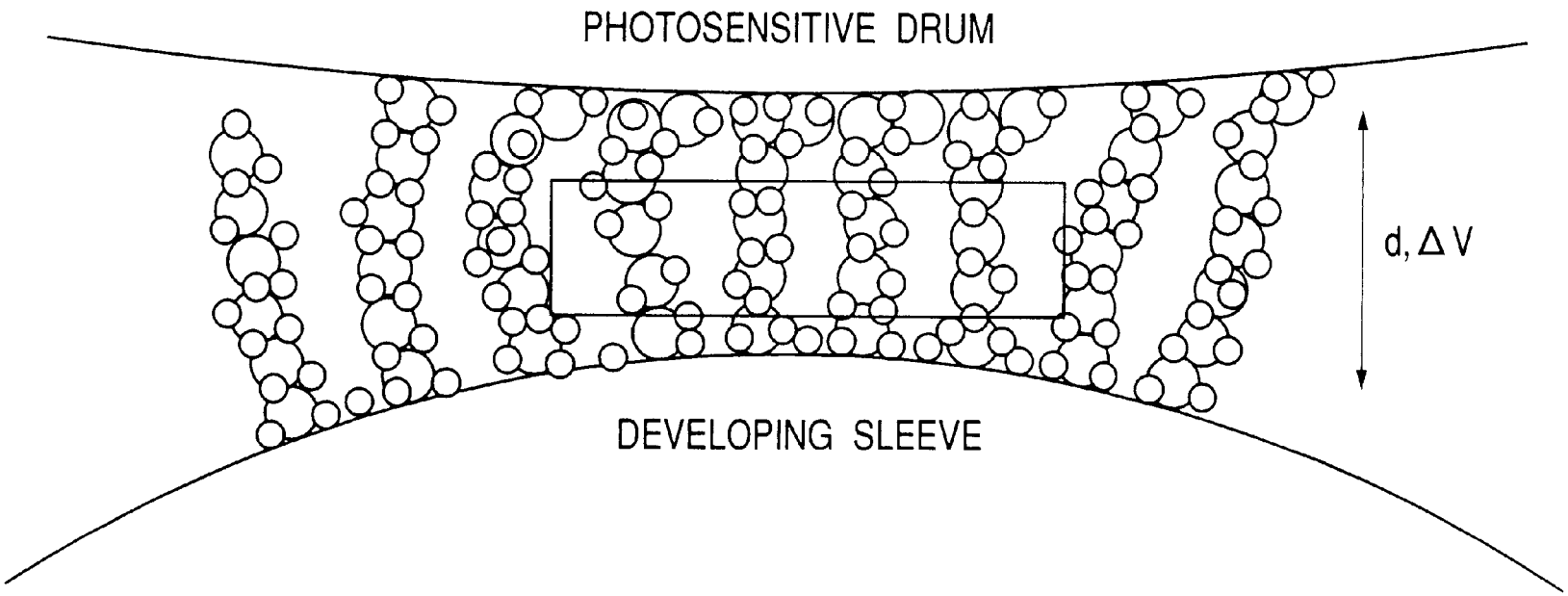
FIG. 26 is a view showing the force applied to a toner particle on a developing sleeve.
Figure 27:
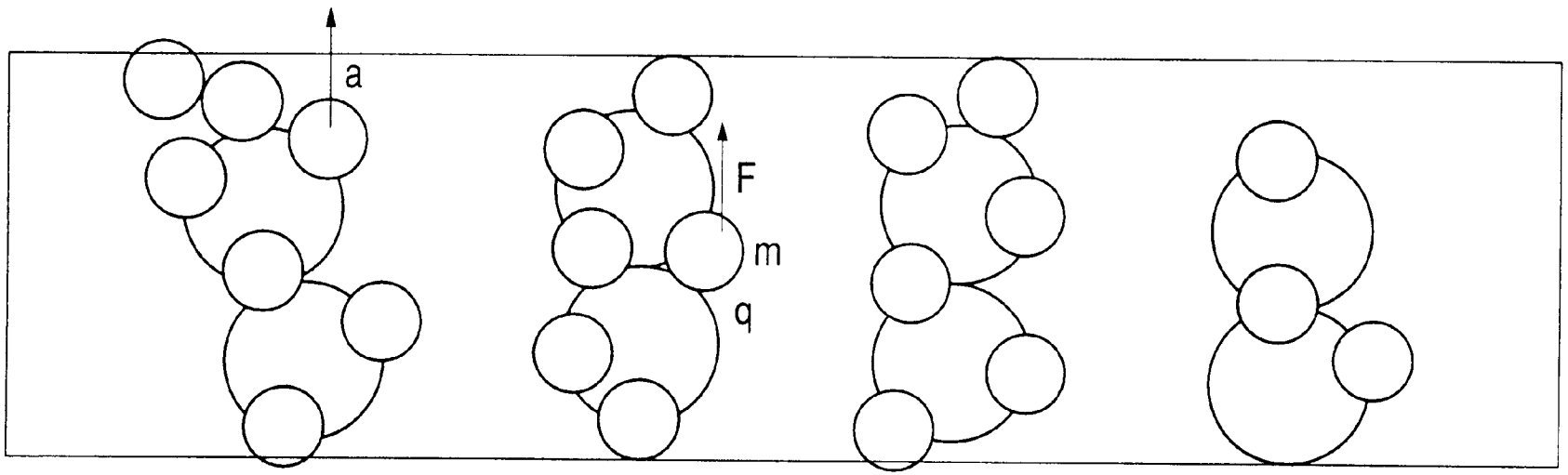
FIG. 27 is an enlarged view of FIG. 26.

The foregoing situation now will be described. FIG. 26 is a drawing to show a force applied to toner particles on the developing sleeve, and FIG. 27 is an enlarged view thereof. In the drawing, reference character q denotes a quantity of electric charge of toner, reference character m denotes mass, reference character a denotes acceleration, reference character ΔV denotes a potential difference between the photosensitive drum and the developing sleeve, and reference character d denotes a gap between the photosensitive drum and the developing sleeve.

A distance X for which toner can move from the photosensitive drum to the developing sleeve is given as follows. An exfoliation voltage to bring toner back to the developing sleeve is applied to toner for maximum time of Tb seconds during a period when oscillating electric field is being applied. The distance X for which toner can move during this period is given by the following equation (3):

$$X=|Q|\cdot|Vb-Vcont|\cdot Tb^2/2d \quad (3)$$

Here, the toner having undergone developing onto the photosensitive drum is set under condition that it is not returned to the developing sleeve for a moving distance X in the case where an exfoliation voltage is applied for the maximum time period so that the toner repeats biased oscillation on the photosensitive drum. A condition at this time is when X becomes smaller than the gap d between the photosensitive drum and the developing sleeve.

The above is expressed by an equation as follows:

$$X=|Vb-Vcont|\cdot Tb^2/2<d^2/|Q| \quad (4)$$

When development is implemented under such conditions, the oscillating portion is under a state that even an electric field with an exfoliation voltage for a maximum time period cannot implement sufficient alternating movement between S and D, and thereafter during shifting to the pause portion, for the toner having obtained the maximum acceleration to cling to the photosensitive drum, the developing bias is designed to provide with potential on the developing sleeve that reaches the blank potential without any overshoot so that the toner faithfully undergoes developing steps toward developing contrast with the maximum velocity produced in the oscillating portion in such a direction that makes it fly onto the photosensitive drum Therefore, the DC component works so as to attract toner in quantity matching latent image potential to the photosensitive drum even in the case where the peak-to-peak voltage Vpp is low, thereby no longer giving rise to any lack of dots. In addition, on the photosensitive drum, toner repeats intermittent oscillation so that toner is concentrated to the latent image section and every dot is reproduced faithfully, and thus even with such vague latent image from which a conventional rectangular bias can only provide an uneven image, uniform images become available for outputting.

As described so far, embodiment of the present invention have been described, but the present invention will not be limited to these embodiments, and within the scope of technical idea of the present invention any variation is possible.

As described so far, in the developing apparatus of this embodiment, a blank pulse bias comprising an oscillating portion and a pause portion for a waveform cycle is adopted as a developing bias voltage to be applied to a developer carrying body with bias application means, and at the time when that bias voltage shifts from the oscillating portion to the pause portion, the potential on the developer carrying body is arranged to reach the pause portion without any overshoot toward the pause portion potential, and therefore even under a condition that frequencies are high and peak-to-peak voltages are low, uniformity of image is high and images with a sufficient density are available, without giving rise to any poor image due to an abnormal discharge so that images with a high image quality have become constantly available.

In addition, in the blank pulse bias shown in the Embodiments 1 to 5, it is obvious that at the time when that bias voltage shifts from the oscillating portion to the pause portion, also by arranging the potential on the developer carrying body to reach the pause portion without any overshoot toward the pause portion potential, even under a condition that frequencies are high and peak-to-peak voltages are low, uniformity of image is high and images with a sufficient density are available, without giving rise to any poor image due to an abnormal discharge so that images with a high image quality become constantly available.

What is claimed is:

1. A developing apparatus comprising:

a developer carrying body disposed so as to face an image bearing body, wherein said developer carrying body carries and conveys a developer including toner and carrier to a developing region; and bias applying means for applying a developing bias to said developer carrying body, wherein said bias applying means periodically applies to said developer carrying body the developing bias that has an alternating voltage portion having a first voltage to generate an electric field to direct toner from said developer carrying body to said image bearing body and a second voltage to generate an electric field to direct the toner from said image bearing body to said developer carrying body, and a pause portion to pause applying the alternating voltage portion, wherein T1 and T2 have a relationship of T1>T2, where T1 is as an applying time period of said first voltage and T2 is an applying time period of said second voltage, and wherein the following relationship is satisfied:

$$|Vpp-2Vcont|\cdot Tb^2/4<d^2/|Q|,$$

where Vpp is a peak-to-peak voltage of the developing bias, Tb is a maximum time (seconds) for the alternating voltage portion applied to said developer carrying body to bring the toner back to said developer carrying body, Vcont is an image contrast potential voltage, Q is an average charging quantity of triboelectricity of said toner (C/kg), and d is a distance (m) between said image bearing body and said developer carrying body.

2. A developing apparatus according to claim 1, wherein a potential difference between the first voltage and the second voltage is less than 2 kV.

3. A developing apparatus according to claim 1, wherein the developing bias changes from the first voltage to the pause portion of the developing bias.

4. A developing apparatus according to claim 1, wherein the alternating voltage portion of the developing bias is substantially rectangular.

5. A developing apparatus according to claim 1, wherein a ratio of the alternating voltage portion to the pause portion of the developing bias is 1:1/2 to 1:15.

6. A developing apparatus according to claim 1, wherein at the time of shifting from the alternating voltage portion to the pause portion of the developing bias, a potential of said developer carrying body is arranged to reach the pause portion of the developing bias without any overshoot over a pause portion potential.

7. A developing apparatus comprising:

a developer carrying body for bearing and carrying a developer having a toner and a carrier to a developing region for developing an electrostatic latent image formed on an image bearing body; and bias applying means for applying a developing bias to said developer carrying body, wherein the bias applying means periodically applies an alternating voltage portion that has a first peak voltage V1 for forming an electric field biasing the toner from said developer carrying body to said image bearing body and a second peak voltage V2 for forming an electric field biasing the toner from said image bearing body to said developer carrying body, and a direct current voltage portion for applying only a direct current voltage to said developer carrying body, and wherein when a time for applying the V1 is set as T1, as a time for applying the V2 is set as T2, an effective center value of the developing bias is set as Vc, T2<T1 and |Vc−V2|<|Vc−V1| are satisfied.

8. A developing apparatus according to claim 7, wherein the alternating voltage portion is substantially a rectangular wave.

9. A developing apparatus according to claim 7, wherein the following relationship is satisfied:

$$|Vpp-2Vcont|\cdot Tb^2/4<d^2/|Q|,$$

where Vpp is a peak-to-peak voltage of said developing bias, Tb is a maximum time (seconds) for an alternating voltage applied to said developer carrying body to bring the toner back to said developer carrying body, Vcont is an image contrast potential, Q is an average charging quantity of triboelectricity of the toner (C/kg), and d is a distance (m) between said image bearing body and said developer carrying body.

10. A developing apparatus comprising:

a developer carrying body provided to face an image bearing body, wherein said developer carrying body carriers and conveys a developer having toner and carrier to a developing region; and bias applying means for applying a developing bias to said developer carrying body, wherein said bias applying means periodically applies to said developer carrying body said developing bias having an alternating voltage portion having a first voltage to generate an electric field to direct toner from said developer carrying body to said image bearing body and a second voltage to generate an electric field to direct the toner from said image bearing body to said developer carrying body, and a pause portion to pause applying the alternating voltage, wherein a potential different Vg between an effective center voltage of the developing bias and the first voltage is larger than a potential difference Vb between an effective center voltage of the developing bias and the second voltage, and wherein the following relationship is satisfied:

$$|Vpp-2Vcont|\cdot Tb^2/4<d^2/|Q|,$$

where Vpp is a peak-to-peak voltage of the developing bias, Tb is a maximum time (seconds) for the alternating voltage portion applied to said developer carrying body to bring the toner back to said developer carrying body, Vcont is an image contrast potential, Q is an average charging quantity of triboelectricity of the toner (C/kg), and d is a distance (m) between said image bearing body and said developer carrying body.

11. A developing apparatus according to claim 10, wherein the potential differences Vg and Vb, and wherein the following relationship is satisfied:

$$1<Vg/Vb\leqq 1.5.$$

12. A developing apparatus according to claim 10, wherein at the time of shifting from the alternating voltage portion to the pause portion, wherein potential of said developer carrying body is arranged to reach the pause portion without any overshoot over a pause portion potential.

* * * * *

UNITED STATES PATENT AND TRADEMARK OFFICE

CERTIFICATE OF CORRECTION

PATENT NO. : 6,459,862 B1
DATED : October 1, 2002
INVENTOR(S) : Yuji Sakemi et al.

It is certified that error appears in the above-identified patent and that said Letters Patent is hereby corrected as shown below:

Title page,
Item [57], ABSTRACT,
Line 14, “as” should be deleted.

Column 1,
Line 7, “photocopier” should read -- a photocopier --; and
Line 43, “seconds).” should read -- μs). --.

Column 2,
Line 1, “is to” should read -- to --;
Line 10, “alternate” should read -- alternating --;
Line 21, “is to” should read -- to --; and
Line 65, “showing a” should read -- showing --.

Column 3,
Line 17, “is” should read -- is a --.

Column 4,
Line 3, “not shown sheet conveyer,” should read -- sheet conveyer (not shown), and --; and
Line 54, “obtained” should read -- been obtained --.

Column 5,
Line 14, “adheres” should read -- which adheres --;
Lines 32 and 34, “to be” should read -- be --; and
Line 57, “occurs” should read -- occur --.

Column 6,
Line 7, “not shown amplifying circuit,” should read -- amplifying circuit (not shown), --; and
Line 8, “not shown video processing unit,” should read -- video processing unit (not shown), --.

Column 7,
Line 11, “drived,” should read -- driven, --;
Line 19, “cyan toner image” should be deleted;
Line 20, “obtained by development with the” should be deleted; and
Line 41, “cesses” should read -- cess --.

UNITED STATES PATENT AND TRADEMARK OFFICE

CERTIFICATE OF CORRECTION

PATENT NO. : 6,459,862 B1
DATED : October 1, 2002
INVENTOR(S) : Yuji Sakemi et al.

It is certified that error appears in the above-identified patent and that said Letters Patent is hereby corrected as shown below:

Column 8,
Line 10, “is operated” should be deleted.

Column 9,
Line 31, “[v](a” should read -- [V] a --; and
Line 52, “undergoes swinging with a human hand” should read -- is shaken by hand --.

Column 10,
Line 33, “half tone” should read -- halftone --.

Column 11,
Line 45, “D, moreover” should read -- D. Moreover, --.

Column 12,
Line 17, “As described so far,” should read -- So far, --; and “embodiment” should read -- embodiments --; and
Line 44, “not shown” should be deleted; and “supply” should read -- supply (not shown) --.

Column 13,
Line 29, “rise of” should read -- rise to --;
Line 60, “non-image” should read -- nonimage --; and
Line 63, “than” should read -- rather than --.

Column 14,
Line 7, “goes” should read -- gets --; and
Line 42, “gets” should read -- becomes --.

Column 15,
Line 40, “filed” should read -- field --;
Line 43, “portion” should read -- portion, --; and
Line 53, “As described so far,” should read -- So far, --; and “embodiment” should read -- embodiments --.

Column 16,
Line 12, “not shown” should be deleted; and “supply” should read -- supply (not shown) --;
Line 17, “shown” should read -- shown in --;
Line 30, “a electric” should read -- an electric --; and
Line 54, “phenomena” should read -- phenomenon --.

UNITED STATES PATENT AND TRADEMARK OFFICE

CERTIFICATE OF CORRECTION

PATENT NO. : 6,459,862 B1
DATED : October 1, 2002
INVENTOR(S) : Yuji Sakemi et al.

It is certified that error appears in the above-identified patent and that said Letters Patent is hereby corrected as shown below:

Column 17,
Line 31, “efficience” should read -- efficiency --.

Column 18,
Line 40, “containers” should read -- container --; and
Line 62, “outputted,” should read -- outputted), --.

Column 19,
Line 52, “drum” should read -- drum. --; and
Line 63, “As described so far,” should read -- So far, --; and “embodiment” should read -- embodiments --.

Column 20,
Line 46, “as” should be deleted.

Column 22,
Line 4, “carriers” should read -- carries --;
Line 17, “different” should read -- difference --;
Line 36, “differences” should read -- differences are --; and
Line 43, “wherein potential” should read -- a potential --.

Signed and Sealed this

Twenty-ninth Day of April, 2003

JAMES E. ROGAN
*Director of the United States Patent and Trademark Office*